US009310715B2

(12) United States Patent
Hattori et al.

(10) Patent No.: US 9,310,715 B2
(45) Date of Patent: Apr. 12, 2016

(54) DEVELOPING DEVICE AND IMAGE FORMING APPARATUS

(71) Applicants: Yoshio Hattori, Kanagawa (JP); Yoshiyuki Fukuda, Tokyo (JP); Sho Akiyama, Tokyo (JP); Yuki Oshikawa, Kanagawa (JP); Noriyuki Kimura, Kanagawa (JP)

(72) Inventors: Yoshio Hattori, Kanagawa (JP); Yoshiyuki Fukuda, Tokyo (JP); Sho Akiyama, Tokyo (JP); Yuki Oshikawa, Kanagawa (JP); Noriyuki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/106,413

(22) Filed: Dec. 13, 2013

(65) Prior Publication Data

US 2014/0169827 A1 Jun. 19, 2014

(30) Foreign Application Priority Data

Dec. 17, 2012 (JP) ..... 2012-275168
Jun. 4, 2013 (JP) ..... 2013-118107

(51) Int. Cl.
*G03G 15/08* (2006.01)

(52) U.S. Cl.
CPC ..... *G03G 15/0865* (2013.01); *G03G 15/0882* (2013.01); *G03G 2215/0875* (2013.01)

(58) Field of Classification Search
CPC ..... G03G 15/0817; G03G 15/0841; G03G 15/0843; G03G 15/0881; G03G 15/0882; G03G 15/0884; G03G 2215/0687; G03G 2215/0877; G03G 2215/088; G03G 2215/00991
See application file for complete search history.

(56) References Cited

U.S. PATENT DOCUMENTS 5,592,268 A * 1/1997 Uehara ..... G03G 15/0942 399/103
6,009,287 A * 12/1999 Goldie ..... G03G 21/181 399/103
6,496,667 B2 * 12/2002 Shiratori ..... G03G 21/1857 399/103
2005/0158071 A1 7/2005 Hosokawa et al.
2008/0085137 A1 4/2008 Suzuki
2009/0041508 A1 2/2009 Oshikawa et al.
2009/0136257 A1 5/2009 Hattori et al.
2011/0058858 A1 3/2011 Fukuda et al.
2011/0103827 A1 * 5/2011 Uneme ..... G03G 15/0808 399/111

(Continued)

FOREIGN PATENT DOCUMENTS

JP 5-333691 12/1993
JP 11-174810 7/1999

(Continued)

*Primary Examiner* — Clayton E Laballe
*Assistant Examiner* — Victor Verbitsky
(74) *Attorney, Agent, or Firm* — Duft Bornsen & Fettig LLP

(57) ABSTRACT

A developing device includes a developer bearer, a development casing in which a developer conveyance channel is formed facing the developer bearer through a communicating area, a developer supply member disposed in the developer conveyance channel, a developer regulator disposed facing a lower portion of the developer bearer to adjust an amount of developer carried on the developer bearer, and a sheet member that is removably installed to seal the communicating area and passes through a gap between the developer regulator and the developer bearer and an opening formed in the development casing. A first end of the sheet member is retained downstream from the gap in a direction of rotation of the developer bearer, and the sheet member is fixed to the development casing at a position across the communicating area from the first end with a second end positioned outside the development casing.

19 Claims, 20 Drawing Sheets

(56) References Cited

U.S. PATENT DOCUMENTS

| | | | |
|---|---|---|---|
| 2011/0217085 | A1 | 9/2011 | Hattori et al. |
| 2012/0163874 | A1 | 6/2012 | Hattori et al. |
| 2013/0034368 | A1 | 2/2013 | Hattori et al. |

FOREIGN PATENT DOCUMENTS

| | | | |
|---|---|---|---|
| JP | 2000-122419 | | 4/2000 |
| JP | 2003-323043 | | 11/2003 |
| JP | 2004-126019 | | 4/2004 |
| JP | 2005-189423 | | 7/2005 |
| JP | 2007-025041 | | 2/2007 |
| JP | 2008-026408 | | 2/2008 |
| JP | 2011-145362 | | 7/2011 |
| JP | 2011-174954 | | 9/2011 |
| JP | 2011-191666 | | 9/2011 |
| JP | 2011174954 | A * | 9/2011 |
| JP | 2013-033077 | | 2/2013 |
| JP | 2013-104932 | | 5/2013 |

* cited by examiner

DEVELOPING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2012-275168, filed on Dec. 17, 2012, and 2013-118107, filed on Jun. 4, 2013, in the Japan Patent Office, the entire disclosure of each of which is hereby incorporated by reference herein.

BACKGROUND OF THE INVENTION

1. Technical Field

The present invention generally relates to a developing device used in an image forming apparatus, such as a copier, a printer, a facsimile machine, or a multifunction machine (or a multifunction peripheral) having at least two of coping, printing, facsimile transmission, plotting, and scanning capabilities, and further relates to a process cartridge and an image forming apparatus that include a developing device.

2. Description of the Background Art

Image forming apparatuses typically include a developing device to develop latent images formed on a latent image bearer (e.g., a photoreceptor) with developer, and two-component developer consisting essentially of toner (toner particles) and magnetic carrier (carrier particles) is widely used. The developer bearer has multiple magnetic poles provided thereinside to carry developer on a rotary surface thereof (i.e., sleeve) and supplies toner included in the developer to a development range facing the latent image bearer, thereby developing the latent image formed on the latent image bearer.

There are developing devices that include multiple developer conveyance channels each provided with a developer conveyance member to transport developer in a direction of a rotation shaft (i.e., axial direction) of the developer bearer. While developer is circulated in the developer conveyance channels, a part of the developer is supplied to the surface of the developer bearer. After passing through the development range, developer is collected from the developer bearer and again circulated together with developer existing in the developer conveyance channel. In response to the amount of toner consumed in the development range, toner is supplied through a toner supply inlet to the developing device and mixed with the exiting developer.

In developing devices using two-component developer, typically developer (i.e., initial developer) is contained in the developing device before shipment. If the developer bearer is kept in contact with developer for long time, there is a risk that developer firmly adheres to the developer bearer.

To avoid such an inconvenience, the developer bearer is isolated from the initial developer during transport or storage.

For example, the developing device may be provided with (or shipped with) an easily removable sheet member (e.g., a sealing sheet) to separate the developer bearer from a space (i.e., a developer chamber) containing developer during transport and storage of the developing device, thereby preventing firm adhesion of developer to the developing roller.

An image forming apparatus incorporating the developing device in this state may be shipped. Alternatively, the developing device may be shipped independently as a replacement unit since the operational life thereof is shorter than an apparatus body of the image forming apparatus. The sealing sheet can be incorporated in the developing device also in this state.

Users remove the sealing sheet from the image forming apparatus or the developing device as the replacement unit to enable development operation before using the developing device.

For example, JP-4341957-B (JP-2005-189423-A) proposes a sealing sheet bonded to the development casing to seal an opening through which the developer bearer communicates with an interior of the developer conveyance channel serving as a supply channel. In removal of the sealing sheet, the sealing sheet is pulled in a direction parallel to the axial direction of the developer bearer.

There are two-component type developing devices that includes two screws, serving as the developer conveyance members, arranged in parallel to each other, and one of the two screws is disposed facing the developing roller. The screw (i.e., a supply screw) facing the developing roller simultaneously supplies developer to and collects developer from the developing roller. Such a developing device is called a horizontal biaxial circulation-type developing device.

In this developing device, the developer conveyance channel facing the developer bearer is used for supplying developer to the developer bearer and collecting developer from the developer bearer, which is hereinafter referred to as "supply-collection common channel". After toner therein is consumed in image development, developer returns to the identical developer conveyance channel and again used in image development.

By contrast, there are supply-collection separation type developing devices in which a developer bearer for supplying developer to the developer bearer and a collecting channel for collecting developer therefrom are disposed facing the developer bearer. The supply channel and the collecting channel are separated, at least partly, from each other, and a collecting screw is provided in the collecting channel in addition to the supply screw provided in the supply screw. In this configuration, developer supplied from the supply channel to the developing roller and deprived of toner is not returned to the supply channel but is received in the collecting channel, which is referred to as unidirectional circulation.

SUMMARY OF THE INVENTION

In view of the foregoing, one embodiment of the present invention provides a developing device that includes a developer bearer to transport by rotation developer carried on a surface thereof to a development range facing a latent image bearer, a development casing in which a developer conveyance channel is formed to face the developer bearer through a communicating area, a developer supply member disposed in the developer conveyance channel, a developer regulator disposed facing a lower portion of the developer bearer to adjust an amount of developer carried on the developer bearer, and a sheet member removably installed in the development casing to seal the communicating area between the developer bearer and the developer conveyance channel. The developer supply member transports developer in an axial direction of the developer bearer and supplies developer to the developer bearer, and the developer bearer supplies developer to a latent image formed on the latent image bearer.

The sheet member passes through a gap between the developer regulator and the developer bearer and an opening formed in the development casing. A first end of the sheet member is retained downstream from the gap in a direction of rotation of the developer bearer. The sheet member is fixed to the development casing at a position across the communicating area from the first end thereof, and a second end of the sheet member opposite the first end is positioned outside the development casing.

Another embodiment provides an image forming apparatus that includes the latent image bearer on which a latent image is formed, a charging device to charge the latent image bearer, a latent image forming device to form a latent image on the latent image bearer, and the above-described developing device to develop with developer the latent image.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
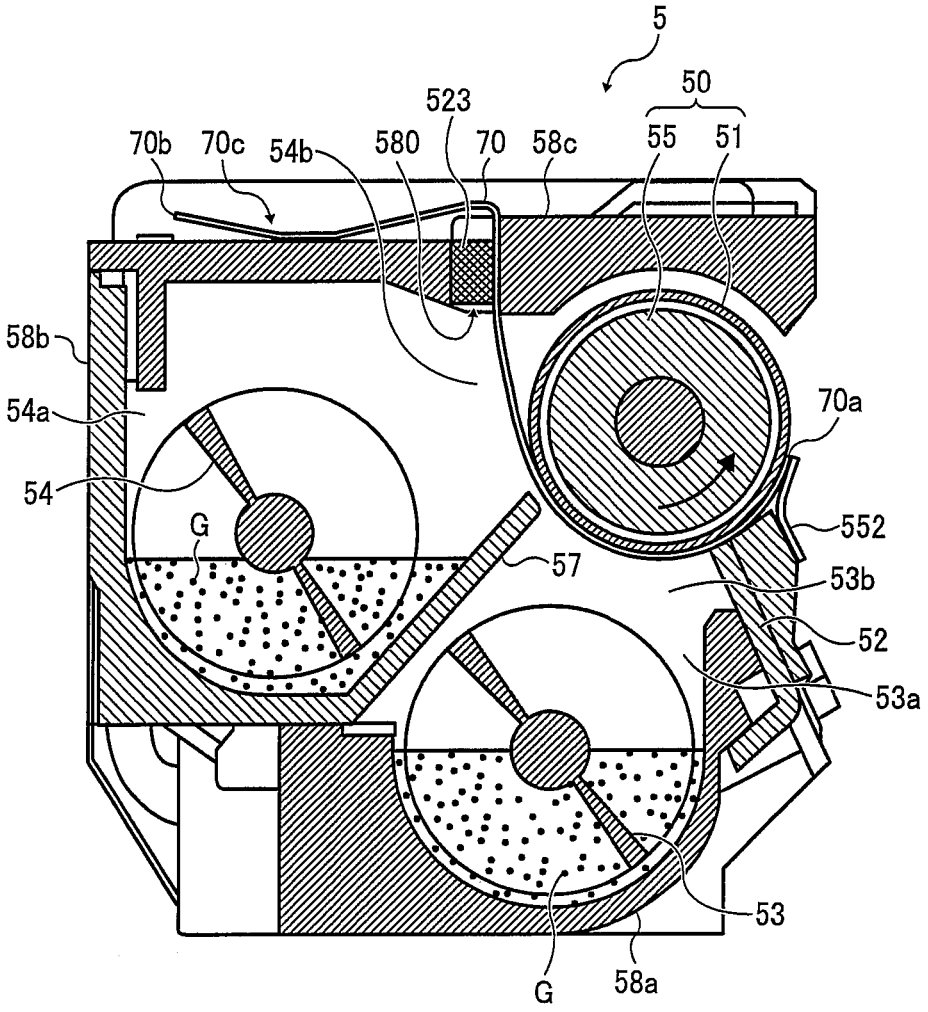
FIG. 1 is a cross-sectional view of a developing device before use, according to a first embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
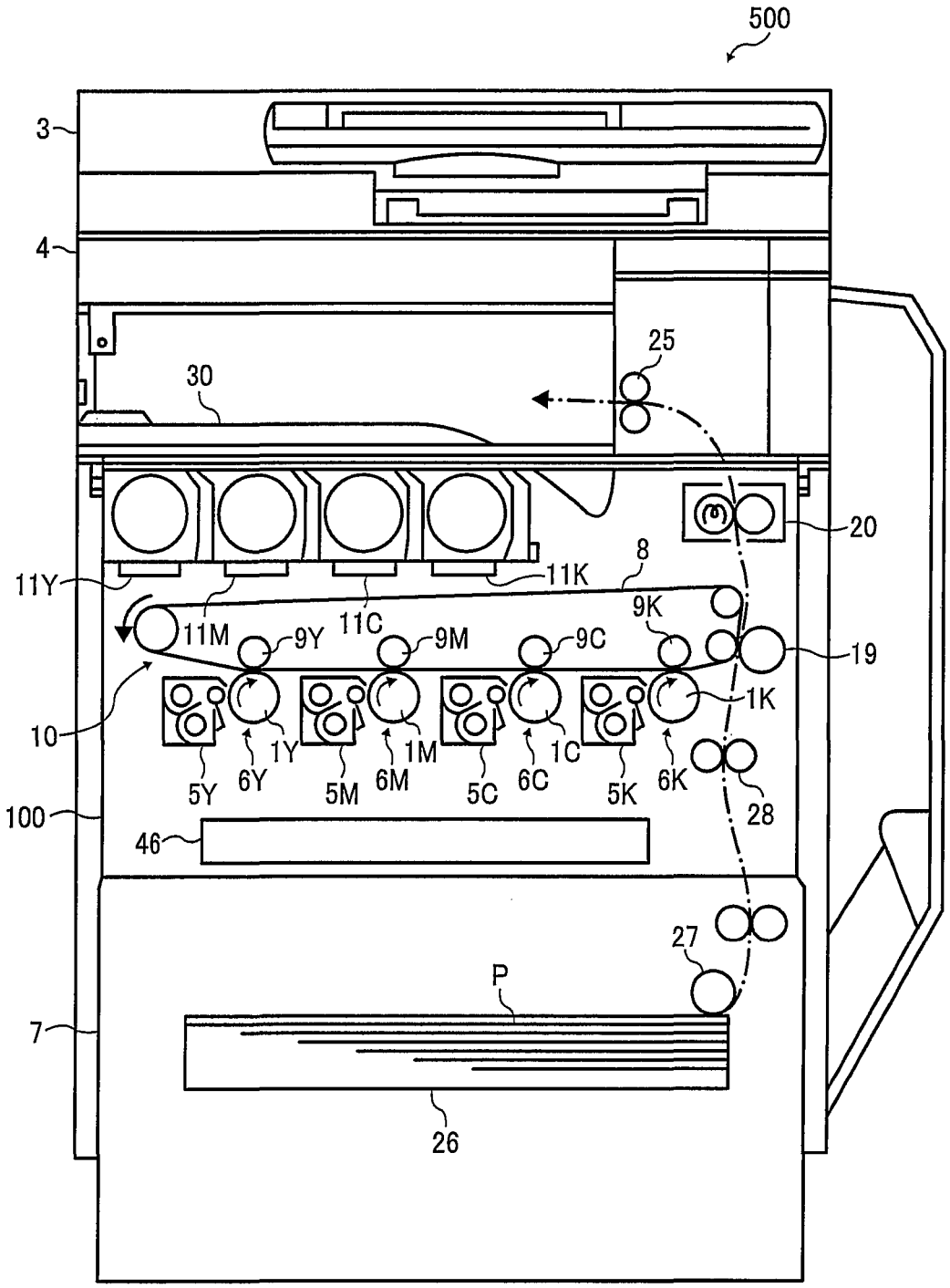
FIG. 2 is a schematic diagram illustrating an image forming apparatus commonly applicable to first to ninth embodiments of the present invention.

Referring now to the drawings, wherein like reference numerals designate identical or corresponding parts throughout the several views thereof, and particularly to FIG. 2, an image forming apparatus 500 according to an embodiment of the present invention is described.

FIG. 2 is a schematic diagram that illustrates a configuration of the image forming apparatus 500. For example, the image forming apparatus 500 is an tandem-type multicolor copier.

Initially, descriptions are given below of a common structure applicable to various embodiments in this specification.

The image forming apparatus 500 includes a printer unit 100 serving as an apparatus body, a document reading unit 4 and a document feeder 3, both disposed above the printer unit 100, and a sheet feeding unit 7 disposed beneath the printer unit 100. The document feeder 3 feeds originals to the document reading unit 4, and the document reading unit 4 reads image data of the originals. The sheet feeding unit 7 includes a sheet tray 26 containing sheets P of recording media (transfer sheets), and a feed roller 27 to feed the sheets P from the sheet tray 26 to the printer unit 100. It is to be noted that broken lines shown in FIG. 2 represent a conveyance channel through which the sheet P is transported inside the image forming apparatus 500.

A discharge tray 30 on which output images are stacked is formed on the upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoreceptor 1 serving as an image bearer on which a toner image is formed, and a developing device 5 for developing an electrostatic latent image formed on the photoreceptor 1 into the toner image.

The intermediate transfer unit 10 includes an intermediate transfer belt 8 and four primary-transfer bias rollers 9Y, 8M, 9C, and 9K. The intermediate transfer belt 8 serves as an intermediate transfer member onto which the toner images are transferred from the respective photoreceptors 1, and the toner images are superimposed one on another thereon, thus forming a multicolor toner image. The primary-transfer bias rollers 9 serve as primary-transfer members to primarily transfer the toner images formed on the photoreceptors 1 onto the intermediate transfer belt 8.

The printer unit 100 further includes a secondary-transfer bias roller 19 to transfer the multicolor toner image from the intermediate transfer belt 8 onto the sheet P. Further, a pair of registration rollers 28 is provided to adjust the timing to transport the sheet P to a secondary-transfer nip formed by the intermediate transfer belt 8 and the secondary-transfer bias roller 19 pressed against it. The printer unit 100 further includes a fixing device 20 disposed above the secondary-transfer nip to fix the toner image on the sheet P.

Additionally, toner containers 11Y, 11M, 11C, and 11K for containing respective color toners supplied to the developing devices 5 are provided inside the printer unit 100, beneath the discharge tray 30 and above the intermediate transfer unit 10.

Figure 3:
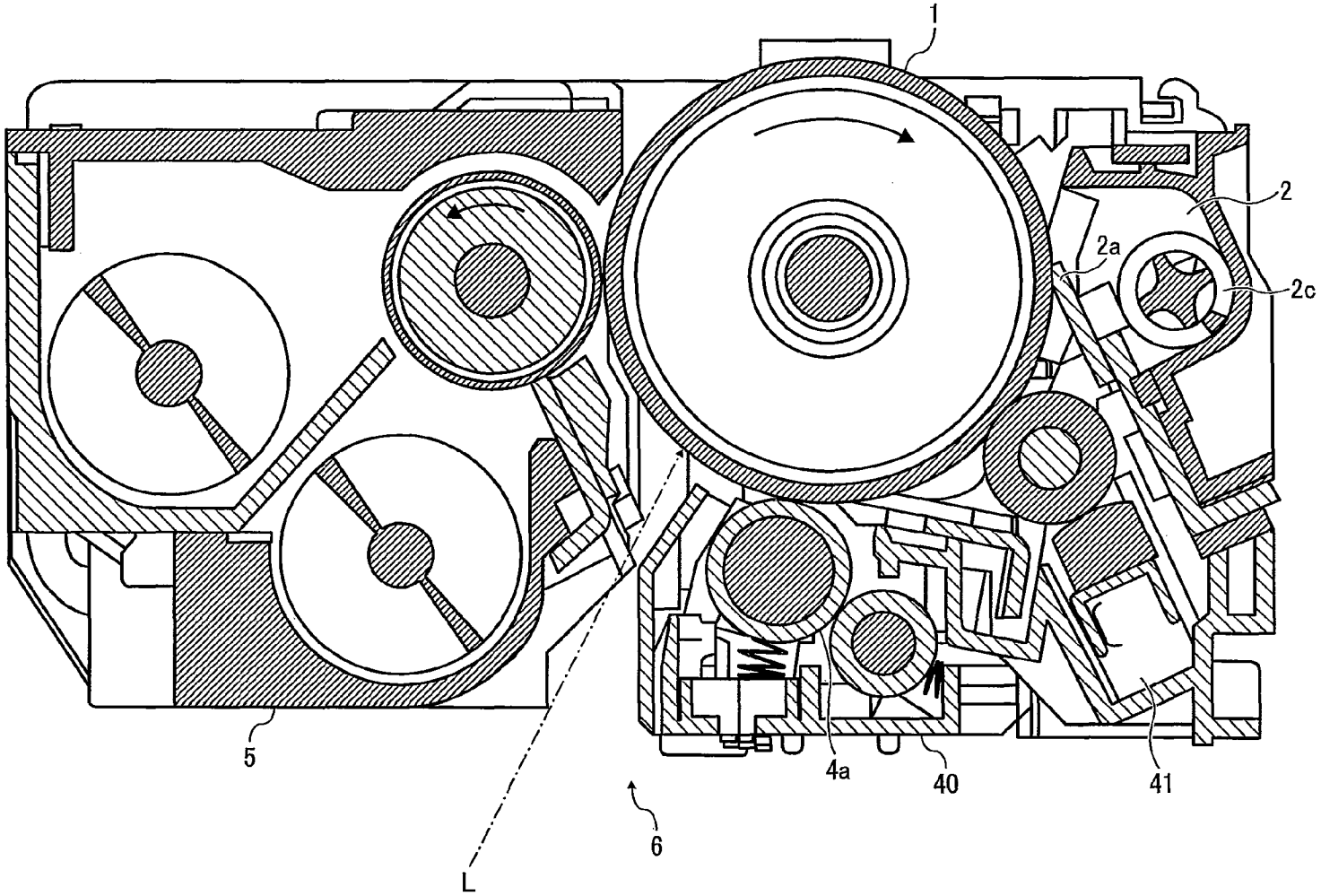
FIG. 3 is a schematic diagram illustrating an image forming unit applicable to the first to ninth embodiments of the present invention.

FIG. 3 is an enlarged view of one of the four image forming units 6.

The four image forming units 6 have a similar configuration except the color of toner used therein, and hereinafter the suffixes Y, M, C, and K may be omitted when color discrimination is not necessary.

As shown in FIG. 3, the image forming unit 6 includes a common unit casing to support the photoreceptor 1 and the developing device 5 and is configured as a modular unit (i.e., a process cartridge) removably installable in the apparatus body of the image forming apparatus 500. Additionally, the image forming unit 6 includes a cleaning unit 2, a charging device 40, and a lubrication device 41 positioned around the photoreceptor 1 in addition to the developing device 5. In the image forming unit 6 according to the present embodiment, the cleaning unit 2 employs a cleaning blade 2*a*, and the charging device 40 employs a charging roller 4*a*.

Descriptions are given below of multicolor image forming operation performed by the image forming apparatus 500.

When a user presses a start button with originals set on a document table of the document feeder 3, conveyance rollers provided in the document feeder 3 transport the originals from the document table onto an exposure glass of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The multicolor image data of the original is decomposed into red, green, and blue (RGB), read by the color sensor, and converted into electrical image signals. Further, an image processor performs image processing (e.g., color conversion, color calibration, and spatial frequency adjustment) according to the image signals, and thus image data of yellow, magenta, cyan, and black are obtained.

Then, the yellow, magenta, cyan, and black image data is transmitted to an exposure device 46 (i.e., a writing unit) serving as a latent image forming unit. Then, the exposure device 46 directs laser beams L to the respective photoreceptors 1 according to the respective color image data.

Meanwhile, the four photoreceptors 1 rotate clockwise in FIGS. 2 and 3. The surface of the photoreceptor 1 is charged uniformly at a position facing the charging roller 4*a* of the charging device 40 (charging process). Thus, charge potentials are formed on the surface of each photoreceptor 1. Subsequently, the surface of the photoreceptor 1 thus charged reaches a position to receive the laser beam L.

Then, the laser beams L according to the respective color image data are emitted from four light sources of the exposure device 46. The laser beams pass through different optical paths for yellow, magenta cyan, and black and reach the surfaces of the respective photoreceptors 1 (exposure process).

The laser beam L corresponding to the yellow component is directed to the photoreceptor 1Y that is the first from the left in FIG. 2 among the four photoreceptors 1. A polygon mirror that rotates at high velocity deflects the laser beam L for yellow in a direction of a rotation axis of the photoreceptor 1Y (main scanning direction) so that the leaser beam L scans the surface of the photoreceptor 1Y. Thus, an electrostatic latent image for yellow is formed on the photoreceptor 1Y charged by the charging device 40.

Similarly, the laser beam L corresponding to the magenta component is directed to the surface of the photoreceptor 1M that is the second from the left in FIG. 2, thus forming an electrostatic latent image for magenta thereon. The laser beam L corresponding to the cyan component is directed to the surface of the photoreceptor 1C that is the third from the left in FIG. 2, thus forming an electrostatic latent image for cyan thereon. The laser beam L corresponding to the black component is directed to the surface of the photoreceptor 1K that is the fourth from the left in FIG. 2, thus forming an electrostatic latent image for black thereon.

Subsequently, the surface of the photoreceptor 1 where the electrostatic latent image is formed is further transported to the position facing the developing device 5. The developing device 5 contains developer including toner (toner particles) and carrier (carrier particles) and supplies toner to the surface of the photoreceptor 1, developing the latent image thereon (development process) into a single-color toner image.

Then, the surfaces of the respective photoreceptors 1 reach positions facing the intermediate transfer belt 8, where the respective primary-transfer bias rollers 9 are provided in contact with an inner circumferential surface of the intermediate transfer belt 8 The primary-transfer bias rollers 9 face the respective photoreceptors 1 via the intermediate transfer belt 8, thus forming primary-transfer nips, where the single-color toner images are transferred from the respective photoreceptors 1 and superimposed one on another on the intermediate transfer belt 8 (transfer process).

Subsequently, the surface of the photoreceptor 1 reaches a position facing the cleaning unit 2, where the cleaning blade 2*a* scraps off toner remaining on the photoreceptor 1 (cleaning process).

Additionally, the surface of each photoreceptor 1 passes through a discharge section, and electrical potentials remaining on the surface of the photoreceptor 1 are removed. Thus, a sequence of image forming processes performed on each photoreceptor 1 is completed, and the photoreceptor 1 is prepared for subsequent image formation.

Meanwhile, the intermediate transfer belt 8 carrying the superimposed single-color toner images (a multicolor toner image) transferred from the four photoreceptors 1 rotates counterclockwise in FIG. 2 and reaches a position facing the secondary-transfer bias roller 19.

Additionally, the feed roller 27 sends out the sheet P from the sheet tray 26, and the sheet P is then guided by a sheet guide to the registration rollers 28. The sheet P is caught in the nip between the registration rollers 28 and stopped. The registration rollers 28 forward the sheet P to the secondary-transfer nip, timed to coincide with the multicolor toner image on the intermediate transfer belt.

In the secondary-transfer nip, the multicolor toner image is transferred from the intermediate transfer belt 8 onto the sheet P (secondary-transfer process).

Subsequently, the intermediate transfer belt 8 reaches a position facing the belt cleaning unit, where toner remaining on the intermediate transfer belt 8 is collected by the belt cleaning unit. Thus, a sequence of transfer processes performed on the intermediate transfer belt 8 is completed.

The toner removed by the cleaning blade 2*a* from the photoreceptor 1 is transported through a waste-toner channel and collected in a waste toner container. The toner (including toner forming a pattern for process control) removed by the belt cleaning unit from the intermediate transfer belt 8 is transported through a waste-toner channel and collected in the waste toner container.

The sheet P carrying the multicolor toner image is sent to the fixing device 20. In the fixing device 20, a fixing belt and a pressing roller are pressed against each other, forming a fixing nip, where the toner image is fixed on the sheet P with heat and pressure.

Then, the sheet P is transported by a pair of discharge rollers 25 and discharged outside the printer unit 100 as an output image onto the discharge tray 30. Thus, a sequence of image forming processes is completed.

Figure 4:
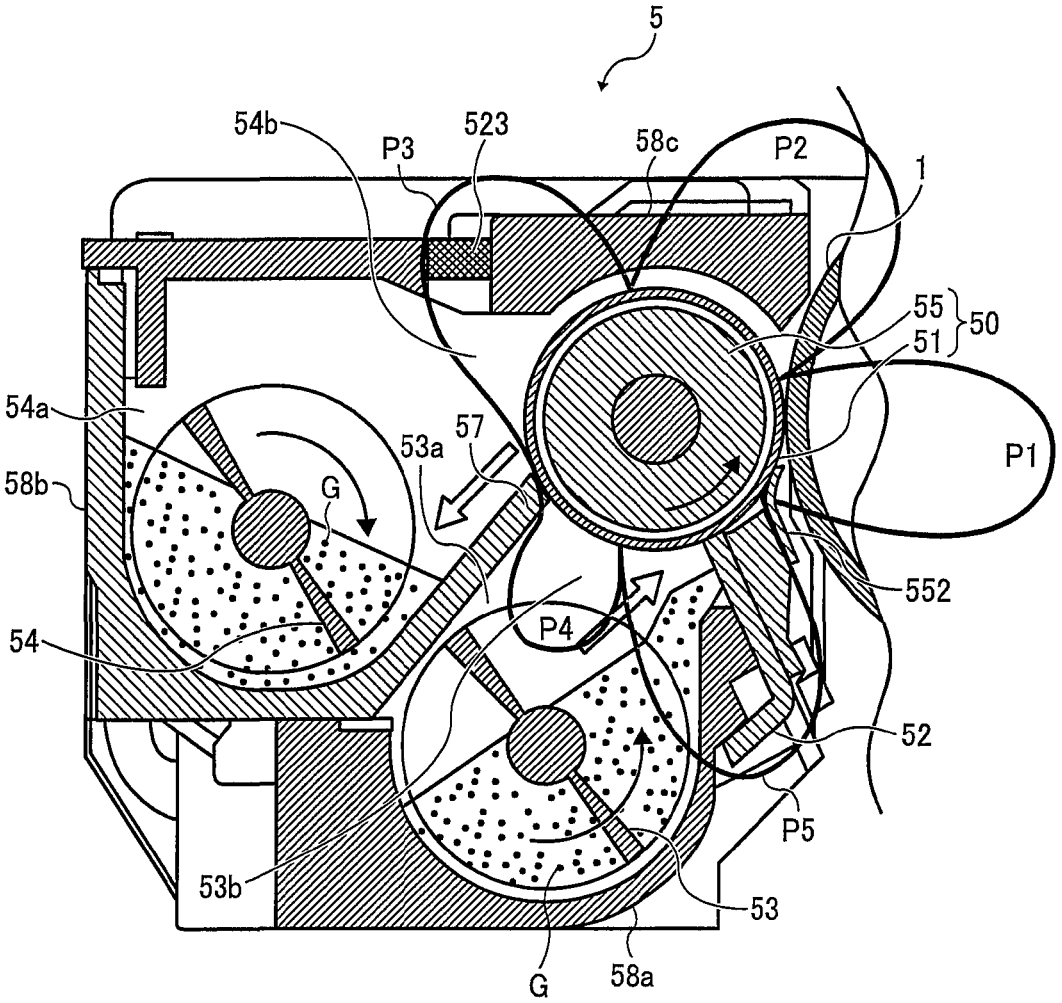
FIG. 4 is a cross-sectional view illustrating a schematic configuration of the developing device applicable to the first to ninth embodiments.
Figure 5:
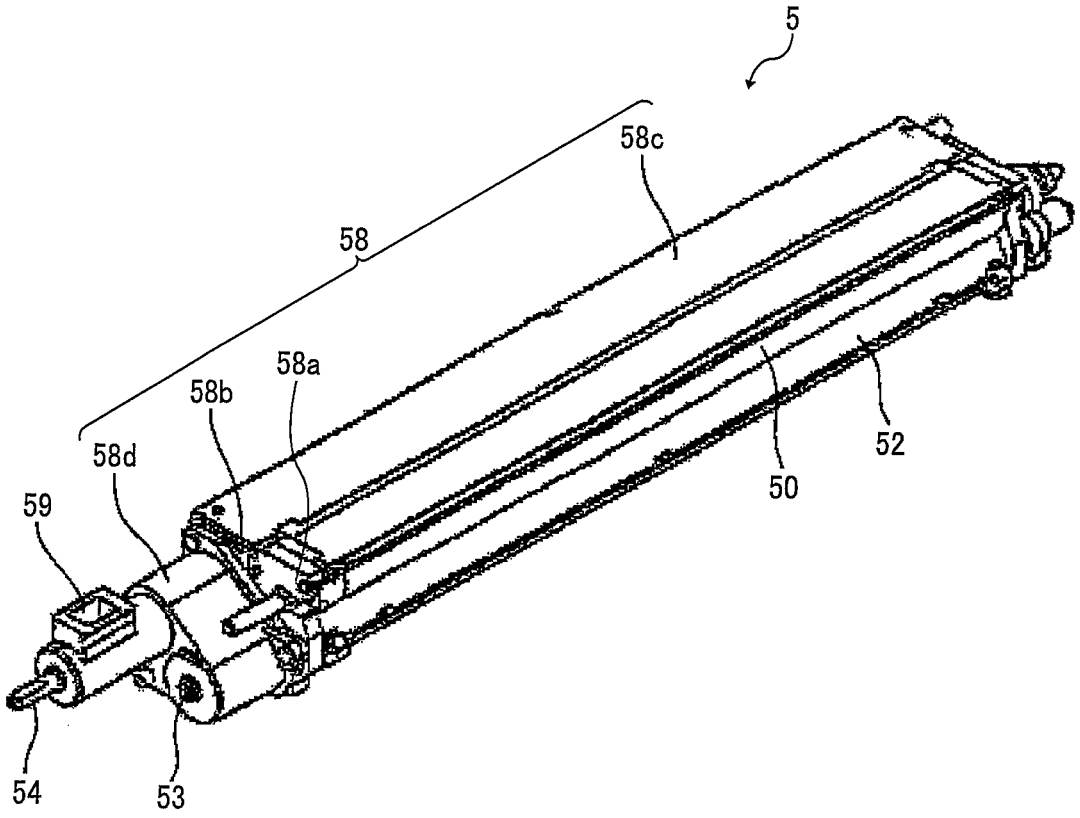
FIG. 5 is a perspective view illustrating a schematic configuration of the developing device applicable to the first to ninth embodiments.

FIG. 4 is a cross-sectional view of the developing device 5 according to the present embodiment, and FIG. 5 is a perspective view of the developing device 5.

The developing device 5 includes a lower case 58*a*, an upper case 58*b*, a development cover 58*c*, and a development front case 58*d* (shown in FIG. 5), together forming a casing 58 (shown in FIG. 5) serving as a development casing in which a developer conveyance channel (such as 53*a* and 54*a*) is formed. It is to be noted that hereinafter the lower case 58*a*, the upper case 58*b*, the development cover 58*c*, and the development front case 58*d* may be collectively referred to as "the casing 58".

The developing device 5 includes a developing roller 50 serving as a developer bearer to transport by rotation developer carried on a surface thereof to a development range to supply developer to a latent image bearer (i.e., the photoreceptor 1), developer conveyance members, namely, a supply screw 53 and a collecting screw 54, a doctor blade 52 serving as a developer regulator disposed facing a lower portion of the developer bearer to adjust an amount of developer carried on the developer bearer, and a partition 57.

The supply screw 53 serves as a developer supply member disposed in the developer conveyance channel (53*a* or 54*a*) to transport developer in the axial direction of the developer bearer and supply developer to the developer bearer. The collecting screw 54 serves as a developer collecting member to transport axially developer received from the developer bearer at a position downstream from the development range in the direction of rotation of the developer bearer.

For example, each of the supply screw 53 and the collecting screw 54 includes a rotation shaft and a spiral blade winding around the rotation shaft and transports developer axially by rotating. Additionally, a development range entrance seal 552 may be provided between the development range and a position where the doctor blade 52 faces the developing roller 50 to prevent scattering of toner.

The partition 57 divides, least partly, an interior of the casing 58 (shown in FIG. 5) of the developing device 5. The partition 57 serves as a partition to divide the developer conveyance channel into a supply channel 53*a* in which the developer supply member (the supply screw 53) is provided and a collecting channel 54*a* in which the developer collecting member (the collecting screw 54) is disposed.

The supply channel 53*a* and the collecting channel 54*a* serve as the developer conveyance channel facing the developer bearer through a communicating area (53*b* and 54*b*) inside the development casing 58. Additionally, on the cross section (shown in FIG. 4) perpendicular to the axial direction, an end face 57*a* (shown in FIGS. 10A, 109, and 11) of the partition 57 faces the developing roller 50 and positioned adjacent to the developing roller 50. Thus, the partition 57 can also serve as a separator to facilitate separation of developer from the surface of the developing roller 50.

The partition 57 having the separating capability can inhibit developer that has passed through the development range, carried on the developing roller 50, from reaching the supply channel 53*a*. Thus, developer is not retained but can move to the collecting channel 54*a*.

Figure 6:
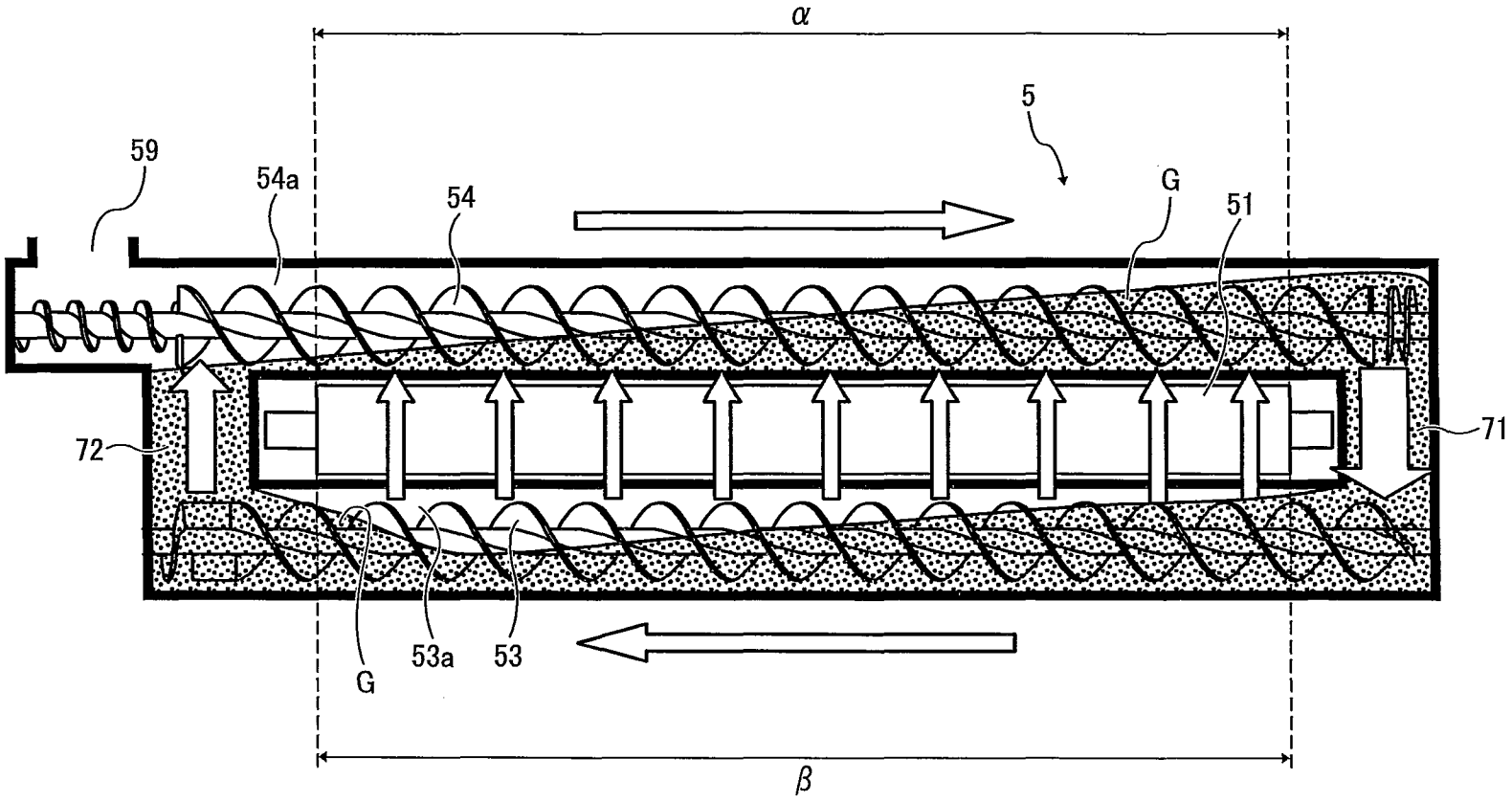
FIG. 6 is a schematic diagram illustrating movement of developer in the developing device in a longitudinal direction thereof, applicable to the first to ninth embodiments.

It is to be noted that reference character G shown in FIGS. 1, 4, 6, and the like represents developer, but generally developer may be without the reference character in this specification.

The developing roller 50 includes a magnet roller 55 and a developing sleeve 51 that rotates around the magnet roller 55. Inside the magnet roller 55, multiple stationary magnets are provided. The developing sleeve 51 is a rotatable, cylindrical member formed with a nonmagnetic material. The magnet roller 55 is housed inside the developing roller 51. The magnet roller 55 according to the present embodiment includes, for example, five magnetic poles (first through fifth poles) P1 through P5. The first, third, and fourth pales P1, P3, and P4 are north (N) poles, and the second and fifth poles P2 and P5 are south (S) poles, for example. It is to be noted that, in FIG. 4, a petal-shaped lines with reference characters P1 through P5 represent density distribution (absolute value) of magnetic flux formed by the respective magnetic poles on the developing sleeve 51 in a direction normal to the surface of the developing sleeve 51.

The developing device 5 contains two-component developer consisting essentially of toner and carrier (one or more additives may be included). The supply screw 53 and the collecting screw 54 transport developer in the longitudinal direction (axial direction of the developing sleeve 51), and thus a developer circulation path is formed inside the developing device 5. Additionally, the supply screw 53 and the collecting screw 54 are arranged vertically, and the supply channel 53*a* and the collecting channel 54*a* are formed with the partition 57 disposed between the two developer conveyance members.

Additionally, the doctor blade 52 is provided beneath the developing roller 50 in FIG. 4 and upstream in the direction of rotation of the developing sleeve 51 from the development range where the developing roller 50 faces the photoreceptor 1. The doctor blade 52 adjusts the amount of developer conveyed to the development range, carried on the developing sleeve 51.

Further, a toner supply inlet 59 is formed in the developing device 5 to supply toner to the developing device 5 in response to consumption of toner since two-component developer is used in the present embodiment.

Next, supply of toner to the developing device 5 is described in further detail below.

Fresh toner contained in the toner container 11 is supplied to and stored in a toner hopper positioned on the rear side of the apparatus body in FIG. 2. When a toner density detector (or toner concentration detector) provided inside the developing device 5 deems that the density of toner inside the developing device 5 falls to or below a threshold, a toner supply screw inside the toner hopper is rotated. The toner supply screw is rotated for a time period calculated using a predetermined convention formula, and a proper amount of toner is supplied from the toner hopper to the toner supply inlet 59 formed in the developing device 5.

A toner detector may be provided inside the toner hopper to detect the presence of toner. When the toner detector detects that no (or little) toner is present at a detection position thereof, a controller requests a toner replenishing device to supply toner.

Upon this request, the toner replenishing device replenishes the toner hopper with toner. When the toner detector detects the presence of toner at the detection position, the toner replenishing device stops replenishment of toner. If the toner detector does not detect the presence of toner even though the controller requests toner supply for a predetermined time period, the controller deems that toner is not present in the toner container 11 (i.e., toner end). Thus, it can be known that the toner container 11 is empty or almost empty.

While being transported, toner supplied through the toner supply inlet 59 is agitated and mixed with developer in the developing device 5 by the collecting screw 54 and the supply screw 53. The developer thus agitated is partly supplied to the surface of the developing sleeve 51 serving as the developer bearer and carried thereon. After the doctor blade 52 disposed beneath the developing sleeve 51 adjusts the amount of developer on the developing sleeve 51, developer is transported to the development range. In the development range, the toner in developer on the developing sleeve 51 adheres to the latent image formed on the surface of the photoreceptor 1. The multiple stationary magnets of the magnet roller 55 provided inside the developing sleeve 51 generate the multiple magnetic poles P1 through P5 for forming magnetic fields around the developing sleeve 51.

The developing device 5 according to the present embodiment is filled with 300 g of developer in which toner particles, including polyester resin as a main ingredient, and magnetic carrier particles are mixed uniformly. For example, the toner has an average particle diameter of about 5.8 μm, the magnetic carrier has an average particle diameter of about 35 μm, and the concentration of toner in developer is about 7% by weight. The supply screw 53 and the collecting screw 54 arranged in parallel are rotated at a velocity of about 600 revolutions per minute (rpm), thereby transporting developer and agitating the toner supplied through the toner supply inlet 59 simultaneously. Thus, the toner and the carrier can be mixed uniformly in the developer, and charge potentials are given to the toner.

While being transported in the longitudinal direction by the supply screw 53 positioned adjacent to and in parallel to the developing sleeve 51, developer in which toner and carrier are mixed uniformly is attracted by the fifth pole P5 of the magnet roller 55 inside the developing sleeve 51 and carried on an outer circumferential surface of the developing sleeve 51. The developer carried on the developing sleeve 51 is transported to the development range as the developing sleeve 51 rotates counterclockwise as indicated by an arrow shown in FIG. 4. The developing sleeve 51 receives voltage from a high-voltage power source, and thus a development field (electrical field) is generated between the developing sleeve 51 and the photoreceptor 1 in the development range. With the development field, the toner in developer is supplied to the latent image formed on the surface of the photoreceptor 1, developing it.

The developer on the developing sleeve 51 that has passed through the development range is collected in the collecting channel 54*a* as the developing sleeve 51 rotates.

Specifically, the developer falls from the developing sleeve 51 to an upper face of the partition 57, slides down the partition 57, and then is collected by the collecting screw 54.

FIG. 6 is a schematic diagram illustrating movement of developer in the longitudinal direction inside the developing device 5. In FIG. 6, outlined arrows indicate the flow of developer in the developing device 5.

Although the partition 57 is not shown in FIG. 6 for simplicity, openings 71 and 72 are formed in end portions of the partition 57 in the longitudinal direction of the developing device 5, thus forming communication portions between the supply channel 53*a* and the collecting channel 54*a*. At the downstream end of the supply channel 53*a* in the direction in which the developer is transported (hereinafter "developer conveyance direction") by the supply screw 53, developer is transported up through the opening 72 (hereinafter "developer-lifting opening 72") formed in the partition 57 to the upstream end the collecting channel 54*a* in the developer conveyance direction therein. By contrast, at the downstream end of the collecting channel 54*a* in the developer conveyance direction by the collecting screw 54, developer is transported through the opening 71 (hereinafter "developer-falling opening 71) formed in the partition 57 to the upstream end of the supply channel 53*a* in the developer conveyance direction therein.

It is to be noted that, although the supply channel 53*a* and the collecting channel 54*a* are illustrated as if they are away from each other in FIG. 6, it is intended for ease of understanding of supply and collection of developer from the developing sleeve 51. The supply channel 53*a* and the collecting channel 54*a* are separated by the planar partition 57 as shown in FIG. 4, and the developer-falling opening 71 and the developer-lifting opening 72 are through holes formed in the partition 57.

As shown in FIG. 6, in the supply channel 53*a* disposed beneath the collecting channel 54*a*, developer is transported axially by the supply screw 53 to the left in FIG. 6. While being transported in the supply channel 53*a* by the supply screw 53, a constant amount of developer can be scooped up to the surface of the developing sleeve 51 by the rotation of the supply screw 53 as well as the magnetic force exerted from the fifth pole P5 (shown in FIG. 4), serving as a developer attracting pole. Then, the developer carried on the developing sleeve 51 passes through the development range and reaches the position (hereinafter "developer release position") of a developer release pole formed by the third and fourth magnetic poles P3 and P4 having the same polarity (N), adjacent to each other. The developer is separated from the developing sleeve 51 by the magnetic force exerted from the developer release pole and the partition 57 serving as the separator and is transported to the collecting channel 54*a*.

The collecting screw 54 in the collecting channel 54*a* disposed above the supply channel 53*a* transports the developer separated from the developing sleeve 51 at the developer release position axially in the direction opposite the direction in which the supply screw 53 transports developer.

Through the developer-lifting opening 72, the downstream end of the supply channel 53 communicates with the upstream end of the collecting channel 54*a*. The developer that is not scooped up to the developing roller 50 is transported by the supply screw 53 to the downstream end of the supply channel 53 and accumulates there. Then, pushed up by the developer transported from behind, the developer moves through the developer-lifting opening 72 to the upstream end of the collecting channel 54*a*.

The toner supply inlet 59 is provided in the upstream end portion of the collecting channel 54*a*, and fresh toner is supplied by the toner replenishing device from the toner container 11 (shown in FIG. 1) through the toner hopper to the toner supply inlet 59 as required. The developer transported to the downstream end of the collecting channel 54*a* falls under its own weight through the developer-falling opening 71 to the upstream end of the supply channel 53*a*.

By transporting developer from the downstream end of the supply channel 53*a* to the collecting channel 54*a* and further from the downstream end of the collecting channel 54*a* to the supply channel 53*a*, developer circulates inside the developing device 5.

The amount of developer in the supply channel 53*a* decreases downstream in the developer conveyance direction therein since the supply screw 53 transports developer while scooping up developer to the developing roller 50.

In the collecting channel 54*a*, developer and the fresh toner supplied through the toner supply inlet 59 are transported by the collecting screw 54 while being mixed together. The amount of developer in the collecting channel 54*a* increases downstream in the developer conveyance direction therein since the collecting screw 54 transports developer while receiving developer that has passed through the development range.

Additionally, the toner density sensor (or toner concentration sensor) is provided beneath the conveying screw 53 in the supply channel 53*a* or beneath the collecting screw 54 in the collecting channel 54*a*. The density of toner inside the developing device 5 can be measured with the toner density sensor as required. Based on the measurement results, the controller can control the toner hopper so that the density of toner is kept to a proper value.

As described above, the supply screw 53 and the collecting screw 54 rotate in the directions shown in FIG. 4, and simultaneously developer is attracted to the developing sleeve 51 by the magnetic attraction exerted by the magnet roller 55. Additionally, the developing sleeve 51 is rotated at a predetermined velocity ratio to the velocity of the photoreceptor 1 to pump up developer to the development range consecutively. Developer is separated from the developing sleeve 51 by the developer release pole formed by the third and fourth poles P3 and P4 generating a repulsive magnetic force. The developer transported to the area in which the magnetic force is exerted is moved in the direction of the composite of direction normal to and tangential to the rotation of the developing sleeve 51. Then, the developer falls under the gravity to the partition 57 and is collected by the collecting screw 54.

Next, descriptions are given below of component layout in developing devices and isolation of the developer bearer from developer contained in the developer conveyance channels.

In the above-described horizontal, biaxial circulation-type developing device, a single screw is used for both of supply of developer to and collection of developer from the developing roller. Accordingly, the concentration of toner in developer tends to decrease on the downstream side in the direction in which the screw transports developer in formation of images having a higher image area ratio.

By contrast, there are unidirectional circulation-type or supply-collection separation type developing devices. In this configuration, supply of developer and collection of developer are performed separately, and developer in which the concentration of toner is lower is not collected in the supply channel nor used in image development. This configuration can suppress deviations in the density of toner images formed on the photoreceptor.

In a configuration in which the supply channel is disposed above the collecting channel and the doctor blade is disposed above the developing roller, developer is supplied downward from the supply channel to the developing roller and then transported in the collecting channel beneath the developing roller. Image development in an arrangement in which the transfer unit is positioned beneath the developing device and the photoreceptor is called forward development. By contrast, that in an arrangement in which the transfer unit is position above these components is called reverse development, which may impose system limitations. Additionally, pressure of developer is increased in a downstream end portion of the collecting channel in the developer conveyance direction therein to lift developer from the collecting channel to the supply channel positioned higher than the collecting channel. All or almost all developer circulating in the developing device passes through the downstream end portion of the collecting channel, and stress on developer increases.

Alternatively, the doctor blade may be disposed beneath the developing roller. In this arrangement, developer is supplied upward from the supply channel to the developing roller and then transported in the collecting channel above the developing roller. In a downstream end portion of the collecting channel in the developer conveyance direction therein, developer falls down under its own weight to the supply channel. This arrangement can obviate the necessity of increasing the pressure of developer in the downstream end portion of the collecting channel and alleviate the stress on developer.

However, in the arrangement in which the collecting channel is above the supply channel, it is possible that developer contained in the collecting channel reaches to a position higher than the end of the partition separating the collecting channel from the supply channel. In this case, developer accumulating in the collecting channel may flow through clearance between the partition and the developing roller down to the supply channel, thus disturbing the unidirectional circulation of developer. If the unidirectional circulation of developer is disturbed, there is a risk that, immediately after separated from the developing roller, developer that has passed through the development range adheres again to the developing roller and transported to the developing roller. Consequently, image failure, such as insufficient image density and uneven image density, is caused. In unidirectional circulation-type developing devices, since the bulk of developer tends to increase gradually downstream in the collecting channel in the developer conveyance direction therein, the possibility of occurrence of the above-described image failure is higher on the downstream side in the collecting channel.

Regarding this inconvenience, the end of the partition separating the collecting channel from the supply channel may be disposed higher to inhibit developer from overstriding the end of the partition and leaking to the supply channel.

There are unidirectional circulation-type developing devices that do not include an easily removable sheet member to shield the developing roller from the developer inside the developer conveyance channels from the following points:

In configurations including two parallel screws and using a single channel provided with one screw is used for supplying and collecting developer (i.e., supply-collection common channel), the portion to be shielded is the space between the developing roller and the supply-collection common channel that forwards developer to and receives developer from the developing roller. Specifically, in this configuration, disposing the sheet member to seal the opening is easier since there is only a single opening to allow passage of developer between the developing roller and the developer conveyance channels.

By contrast, in supply-collection separation type developing devices such as unidirectional circulation-type developing devices, disposing the sealing sheet to shield the developing roller from developer in the developer conveyance channels is more complicated.

In supply-collection separation type developing devices, developer moves through the respective openings and is exchanged between the developing roller and the two developer conveyance channels. Since there are two openings to be sealed, the range shielded by the sealing sheet is wider than that in the supply-collection common type configuration.

Therefore, it is difficult to dispose a single sheet member to seal both of the two openings. Accordingly, it is difficult to bond the sealing sheet to the development casing so that the sealing sheet can cover the wider range to seal the complicated openings.

Additionally, in developing devices using a supply-collection common channel, space is present above a developer conveyance channel that does not give nor receive developer from the developing roller, and the space can be used as a chamber for containing initial developer (fresh developer). In such a configuration, the sheet member can be provided to the opening between the developer conveyance channel and the chamber for containing initial developer. Before the developing device is used, the sheet member is removed to drop the developer under the gravity, thereby filling the developer conveyance channel with the developer.

In supply-collection separation type developing devices as well, a chamber (i.e., an initial developer chamber) may be provided in an upper section of the developing device for containing initial developer (unused developer). In such a configuration, the initial developer chamber communicates with the developer conveyance channel through an opening (hereinafter "initial supply opening"), and the initial supply opening is sealed by the sealing sheet at the shipment. Before the developing device is used, the sealing sheet is removed to drop the initial developer from the initial developer chamber to the developer conveyance channel, thus filling the developer conveyance channel with the developer. In this configuration, no developer is present in the developer conveyance channel in a state in which the sealing sheet is incorporated in the developing device. Accordingly, the developer bearer can be free from developer even if not shielded from the developer conveyance channel that communicates with the developer bearer. Additionally, since the sealing sheet seals only the initial supply opening, it is easier to bond the sealing sheet to the development casing so that the sealing sheet seals the opening.

In a supply-collection separation-type developing device in which the collecting channel is positioned above the supply channel, disposing the initial developer chamber above the collecting channel makes it difficult to keep the image forming apparatus compact in the direction of height. To attain compactness, the space above the supply-collection separation-type developing device is often used to accommodate a transfer device, which includes an intermediate transfer belt or the like lying over the multiple developing devices or multiple photoreceptors.

After the sealing sheet is removed, the initial developer chamber is no use. In removal of the initial developer chamber that is no longer required, it is possible that developer leaks from the initial supply opening. However, when the developing device in which the initial developer chamber is kept is mounted in the apparatus body, the space for the initial developer chamber is wasted. Thus, the image forming apparatus becomes bulkier.

In view of the foregoing, the embodiments described below concern a developing device capable of inhibiting contact of developer with the developer bearer before use while keeping the device compact and further concern a process cartridge and an image forming apparatus that include the developing device.

First Embodiment

Figure 7:
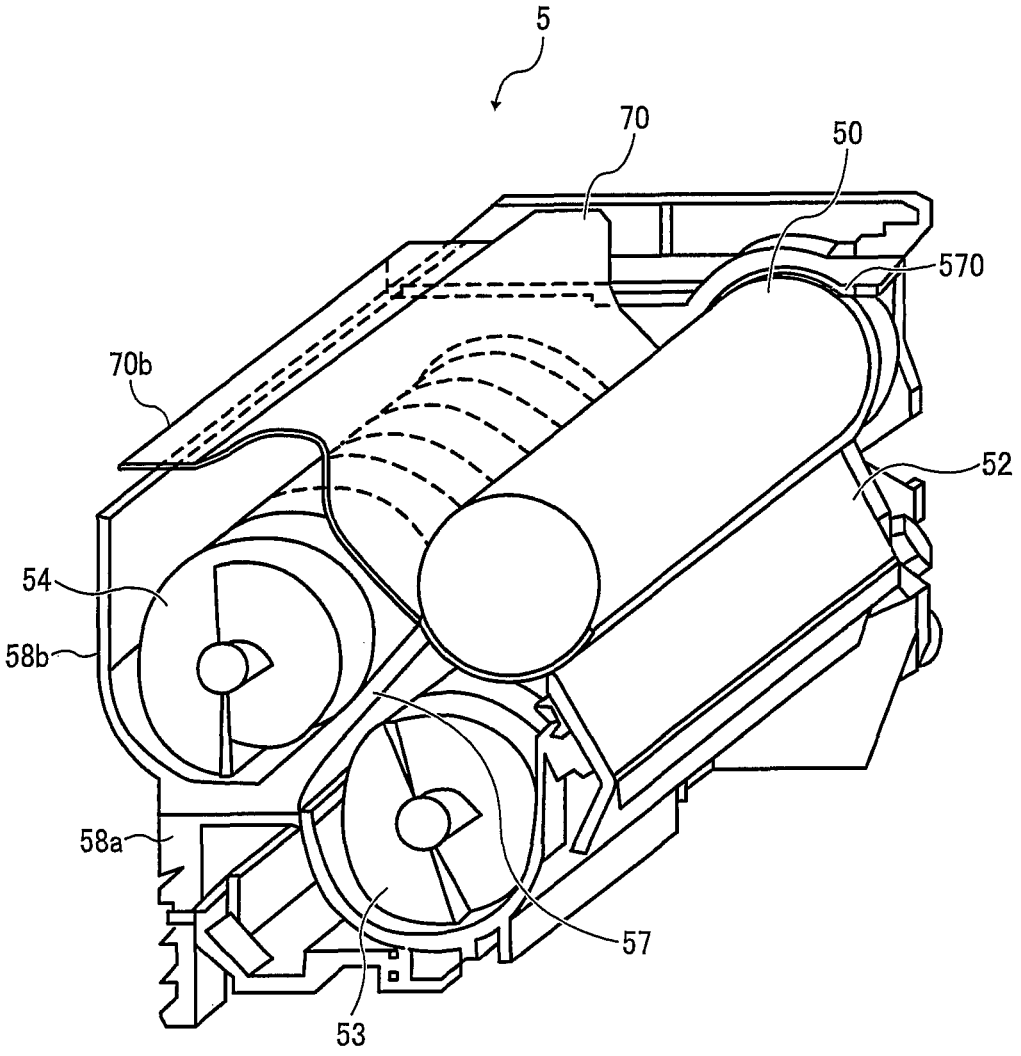
FIG. 7 is a perspective view that partly illustrates the developing device according to the first embodiment.

FIG. 1 is a cross-sectional view of the developing device 5 before shipment, and FIG. 7 is a partial perspective view of the developing device 5 before use.

As shown in FIGS. 1 and 5, the doctor blade 52 is disposed facing the lower portion of the developing roller 50 and developer is contained in the supply channel 53*a* and the collecting channel 54*a* in the developing device 5.

The developing roller 50 communicates with an interior of the supply channel 53*a* through a supply opening 53*b* and with an interior of the collecting channel 54*a* through a collecting opening 54*b*. A sealing sheet 70 (i.e., a preset seal) seals the supply opening 53*b* and the collecting opening 54*b*. The supply opening 53*b* and the collecting opening 54*b* serve as communicating openings for passage of developer. The sealing sheet 70 can be removed from the developing device 5 when a user pulls the sealing sheet 70 from an upper end 70*b*.

In a state in which the sealing sheet 70 is provided, at a lower end 70*a* of the sealing sheet 70 on a cross section (shown in FIG. 1) perpendicular to the axial direction, the sealing sheet 70 passes through the doctor gap between the doctor blade 52 and the developing roller 50. The lower end 70*a* of the sealing sheet 70 is positioned on the outer side than the doctor gap. As shown in FIG. 1, the lower end 70*a* of the sealing sheet 70 overlaps an end of the development range entrance seal 552.

Additionally, a cover opening 580 is formed in the development cover 58*c* (of the casing 58 shown in FIG. 5) positioned above the collecting channel 54*a*, and the sealing sheet 70 passes through the cover opening 580. The upper end 70*b* of the sealing sheet 70 is positioned outside the development cover 58*c*. As shown in FIG. 1, a part of the sealing sheet 70 on the upper side in FIG. 1 serves as a welded portion 70*c* and fixed to an upper face of the development cover 58*c*. For example, the welded portion 70*c* can be welded to the upper face of the development cover 58*c*.

In the axial direction, the sealing sheet 70 extends to shield a range β where the supply channel 53*a* faces the developing roller 50 and a range α where the collecting channel 54*a* faces the developing roller 50. The length of the cover opening 580 matches the width of the sealing sheet 70 (length in the axial direction or longitudinal direction of the developing device 5) so that the sealing sheet 70 sealing the ranges α and β can pass through the cover opening 580.

Additionally, a shutter or cap is provided to seal the toner supply inlet 59 formed in the developing device 5 before the developing device 5 is used, such as at the shipment. Such a shutter or cap is removed from the toner supply inlet 59 either manually for automatically when the developing device 5 is installed in the apparatus body of the image forming apparatus 500.

As shown in FIG. 1, the sealing sheet 70 passes through the doctor gap from outside the casing 58 (shown in FIG. 5), further passes through the clearance between the partition 57 and the developing roller 50, and then exits from the casing 58 through the cover opening 580 formed in the development cover 58*c*. With the sealing sheet 70 extending the above-described route, the supply opening 53*b* and the collecting opening 54*b* can be sealed. Accordingly, inside the developing device 5, the developer contained in the supply channel 53*a* and the collecting channel 54*a* can be isolated from the developing roller 50.

The developer does not penetrate the sealing sheet 70. Accordingly, the developer contained in the supply channel 53*a* or the collecting channel 54*a* does not reach the opposite side beyond the sealing sheet 70 unless the developer goes around the lower end 70*a* or enters from outside the lower end 70*a*.

The sealing sheet 70 passes through the doctor gap on the lower side of the sealing sheet 70, and the lower end 70*a* of the sealing sheet 70 is disposed outside the doctor gap. With this arrangement, it is necessary for the developer contained in the supply channel 53*a* or the collecting channel 54*a* to pass through the doctor gap to go around from outside the lower end 70*a* of the sealing sheet 70. The size of the doctor gap is designed to allow the developer carried on the surface of the developing roller 50, attracted by the magnetic force exerted from the magnet roller 55, to pass through the doctor gap as the developing sleeve 55 rotates in image formation. Therefore, the developer that is not carried on the developing sleeve 51 rarely passes therethrough. Therefore, in the developing device 5 according to the present embodiment, developer can be prevented from going around from outside the lower end 70*a* of the sealing sheet 70 to the circumferential surface of the developing roller 50 even if the lower side of the sealing sheet 70 is not bonded to the casing 58 constructed of the upper case.

Additionally, the sealing sheet 70 is disposed such that the upper end portion of the sealing sheet 70 passes through the cover opening 580 formed in the development cover 58*c* positioned above the collecting channel 54*a*, and the upper end 70*b* is disposed outside the development cover 58*c*. With this arrangement, it is necessary for the developer contained in the supply channel 53*a* or the collecting channel 54*a* to pass through the cover opening 580 to go around from outside the upper end 70*b* of the sealing sheet 70. Since the cover opening 580 is positioned above the collecting channel 54*a* above the supply channel 53*a*, developer does not pass through the cover opening 580 unless some external force causes the developer to move upward against the force of gravity. In a state in which the developing device 5 is provided with the sealing sheet 70, the supply screw 53 and the collecting screw 54, which give conveyance force to developer, are not driven. Thus, chances of external force given to the developer are small. Accordingly, developer is less likely to pass through the cover opening 580.

Even if developer passes through the cover opening 580 and leaks outside of the casing 58, the developer can be thus prevented from reaching to the circumferential surface of the developing roller 50. Therefore, the developer can be prevented from going around from outside the upper end 70*b* of the sealing sheet 70 to the circumferential surface of the developing roller 50 even if the sealing sheet 70 is not bonded to the casing 58. To inhibit leak of developer, a sealing member 523 can be provided to seal clearance between the sealing sheet 70 and an inner wall (rim or mouth) of the casing 58 defining the cover opening 580. Thus, leak of developer can be easily inhibited. In the present embodiment, the sealing member 523 serves as a filter.

Therefore, the developer can be prevented from going around from outside the lower end 70*a* and the upper end 70*b* to the circumferential surface of the developing roller 50 even if the upper and lower sides of sealing sheet 70 are respectively bonded to the casing 58.

In configurations in which one end (on a cross section perpendicular to the axial direction) of the sheet member (i.e., the sealing sheet) is disposed inside the development casing, it is necessary to bond the end portion of the sheet member to an interior of the development casing without clearance to prevent developer from going around from outside the end of the sheet member. Accordingly, a bonding margin is secured inside the casing.

In the configuration, such as the supply-collection separation type developing device, in which the opening range is wide and the opening shape is complicated, it is difficult to secure the bonding margin in the casing, and accordingly bonding the sheet member to the casing is difficult.

By contrast, according to the present embodiment, securing the margin in the casing 58 for the bonding is not necessary, and the sealing sheet 70 can seal wide and complicated communicating openings for passage of developer. With the shielding, the developer contained in the supply channel 53*a* and the collecting channel 54*a* can be prevented from contacting the developing roller 50 before use. Additionally, since the developer is contained in the developer conveyance channels preliminarily, it is not necessary to provide a space (i.e., a chamber) for containing initial developer separately from the developer conveyance channels. Thus, the size of the developing device does not increase.

Thus, the present embodiment can prevent or inhibit developer from contacting the developing roller 50 before use while the developing device 5 can be kept compact.

In the image forming apparatus 500, image failure can arise if images are formed in a state in which the developing roller 50 bears developer firmly adhering thereto. Preventing or inhibiting developer from contacting the developing device 5 before use, as in the present embodiment, is advantageous in suppressing the occurrence of image failure resulting from toner adhering to the developing roller 50.

Additionally, the developing device 5 according to the present embodiment may be incorporated into the image forming unit 6 removably installable in the image forming apparatus 500. When the image forming unit 6 is replaced, the sealing sheet 70 is pulled out from the developing device 5, after which the image forming unit 6 is installed in the apparatus body. This configuration can prevent or inhibit developer from adhering to the developing roller 50 while the image forming unit 6 incorporating the developing device 5 is stored or transported.

It is to be noted that, although polyurethane is used for the sealing sheet 70 in the present embodiment, the material of the sealing sheet 70 is not limited thereto.

In the present embodiment, a sheet member, such as the sealing sheet 70 extending from the doctor gap to the casing 58 above the developer conveyance channel is provided in a unidirectional circulation-type developing device 5 employing biaxial developer conveyance (hereinafter also "biaxial, unidirectional circulation-type"). However, the disposition of the sheet member according to the present embodiment can adapt to unidirectional circulation-type developing devices employing triaxial developer conveyance (hereinafter also "triaxial, unidirectional circulation-type").

Further, the disposition can adapt to developing devices employing the supply-collection common channel. In developing devices employing the supply-collection common channel, the number of openings to be sealed by the sheet member is one, and the opening can be sealed by bonding the sheet member to the casing. However, disposing the sealing sheet 70 to extend from the doctor gap to the casing above the developer conveyance channel, as in the present embodiment, can eliminate the need of bonding the sheet member to the casing, thereby simplifying the manufacturing process and enhancing the flexibility in layout.

Use of this arrangement in biaxial, unidirectional circulation-type developing devices, such as the developing device 5 according to the present embodiment, can inhibit the inconvenience that image density fluctuations in the axial direction are greater compared with supply-collection common type developing devices. Additionally, the horizontal size of the developing device can be compact compared with triaxial, unidirectional circulation-type developing devices.

Additionally, the developing device 5 includes the sealing member 523 (also serving as a filter) to seal the cover opening 580 formed in the development cover 58*c* to inhibit passage of developer. Pores or gaps to allow passage of air are formed in the sealing member 523. In a state in which the developing device 5 is provided with the sealing sheet 70, the sealing member 523 is contracted. When the sealing sheet 70 is removed, the sealing member 523 expands an amount corresponding to the thickness of the sealing sheet 70, thereby sealing the cover opening 580. Thus, the sealing member 523 inhibits developer, small toner particles in particular, from leaking outside the casing 58. Since air can pass through the sealing member 523 serving as the filter, air can escape through the sealing member 523 when air pressure inside the casing 58 increases due to temperature rise therein caused by heat generated by driving of the developing device 5 or the like. Thus, fluctuations in air pressure inside the casing 58 can be suppressed. As the air pressure inside the casing 58 can be inhibited from fluctuating, pressure rise inside the casing 58 can be inhibited. This configuration can inhibit toner from spouting out from clearance between the surface of the developing roller 50 and the casing 58 and clearance in the casing 58 although the spouting out of toner can occur when air pressure in the casing 58 rises.

Hereinafter the side of the sealing sheet 70 opposed to the developing roller 50 is referred to as "roller side", and the opposite side of the sealing sheet 70 opposed to the collecting channel 54*a* is referred to as "channel side". In the developing device 5 shown in FIGS. 1 and 8, the sealing member 523 is disposed across the sealing sheet 70 from the developing roller 50. That is, the sealing member 523 is on the channel side of the sealing sheet 70 opposed to the collecting channel 54*a*. Since the sealing sheet 70 inhibits developer in the supply channel 53*a* and the collecting channel 54*a* from reaching the developing roller 50, it is possible that developer adheres to the sealing sheet 70, in particular, a face (i.e., a second face) on the channel side of the sealing sheet 70 opposite the developing roller 50. If the sealing sheet 70 bearing developer on the second face thereof is removed from the developing device 5, developer may scatter.

In view of the foregoing, the sealing member 523 is disposed across the sealing sheet 70 from the developing roller 50 and contacts the second face of the sealing sheet 70 to which toner can adhere. With this arrangement, when the sealing sheet 70 is pulled out from the developing device 5, the sealing member 523 can wipe off the developer adhering to the second face of the sealing sheet 70, opposite the developing roller 50. Thus, developer can be prevented from scattering.

Sealing the cover opening 580 with the sealing member 523 serving as the filter can inhibit air pressure rise inside the casing 58 and obviate the necessity of separately providing a member to seal the cover opening 580 or a member to clean the sealing sheet 70, thereby suppressing increases in the cost.

Figure 8:
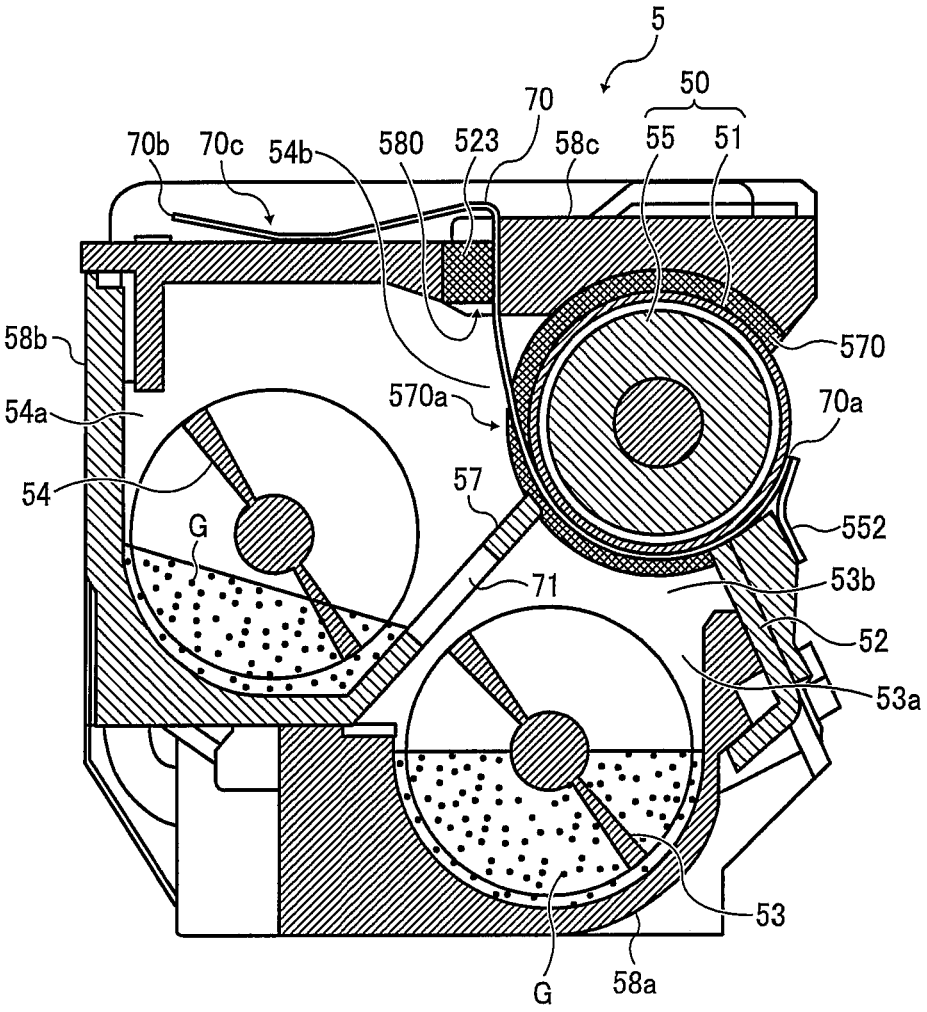
FIG. 8 is a cross-sectional view illustrating an area adjacent to an axial end of the developing device before use, according to the first embodiment.

FIG. 8 is a cross-sectional view illustrating an area adjacent to an axial end of the developing device 5 before use.

As shown in FIGS. 7 and 8, a lateral end seal 570 is provided adjacent to the axial end of the developing device 5. The lateral end seal 570 is disposed to seal clearance between the surface of the developing roller 50 and the casing 58. Although the lateral end seal 570 can be recognized also in the cross section shown in FIG. 1, the reference numeral "570" is omitted to keep the figure simple.

The lateral end seal 570 is a flexible member and can be constructed of sponge, for example. The lateral end seal 570 is disposed between the developing roller 50 and the development cover 58*c* positioned above the developing roller 50 to fill in a clearance, shaped like a partial cylinder, between the developing roller 50 and the development cover 58*c*. In the axial direction of the developing roller 50, the lateral end seal 570 is disposed outside the axial end of the supply channel 53*a* and that of the collecting channel 54*a*. At that position, the casing 58 forms a wall (i.e., an axial end wall) at the axial end of the supply channel 53*a* and that of the collecting channel 54*a*. The portion of the casing 58 forming the axial end wall is shaped to avoid the axial end of the developing roller 50, and a clearance shaped like a partial cylinder is created between the developing roller 50 and the portion of the casing 58 forming the axial end wall. In other words, a clearance that is C-shaped in the cross section shown in FIG. 8 is created between the axial end of the casing 58 and the circumferential surface of the developing roller 50, and the lateral end seal 570 is disposed to fill in the C-shaped clearance.

Additionally, as shown in FIG. 8, a slit 570*a* is formed in the lateral end seal 570 as a through hole from the inner side of the shape "C" to the outer side obliquely to the direction of diameter thereof. The slit 570*a* is adjacent to a position opposed to the partition 57. As shown in FIG. 8, in a range starting from the doctor gap to a position adjacent to the end of the partition 57 facing the developing roller 50, the axial end of the sealing sheet 70 is interposed between the lateral end seal 570 and the surface of the developing roller 50. At the position adjacent to the end of the partition 57 facing the developing roller 50, the sealing sheet 70 passes through the slit 570*a* to the outer side of the shape "C" of the lateral end seal 570. Then, the sealing sheet 70 exits the casing 58 from the cover opening 580.

In the portion where the axial end of the sealing sheet 70 is interposed between the lateral end seal 570 and the surface of the developing roller 50, developer can be prevented from going around the axial end of the sealing sheet 70 from the outside to the surface of the developing roller 50.

Figure 9:
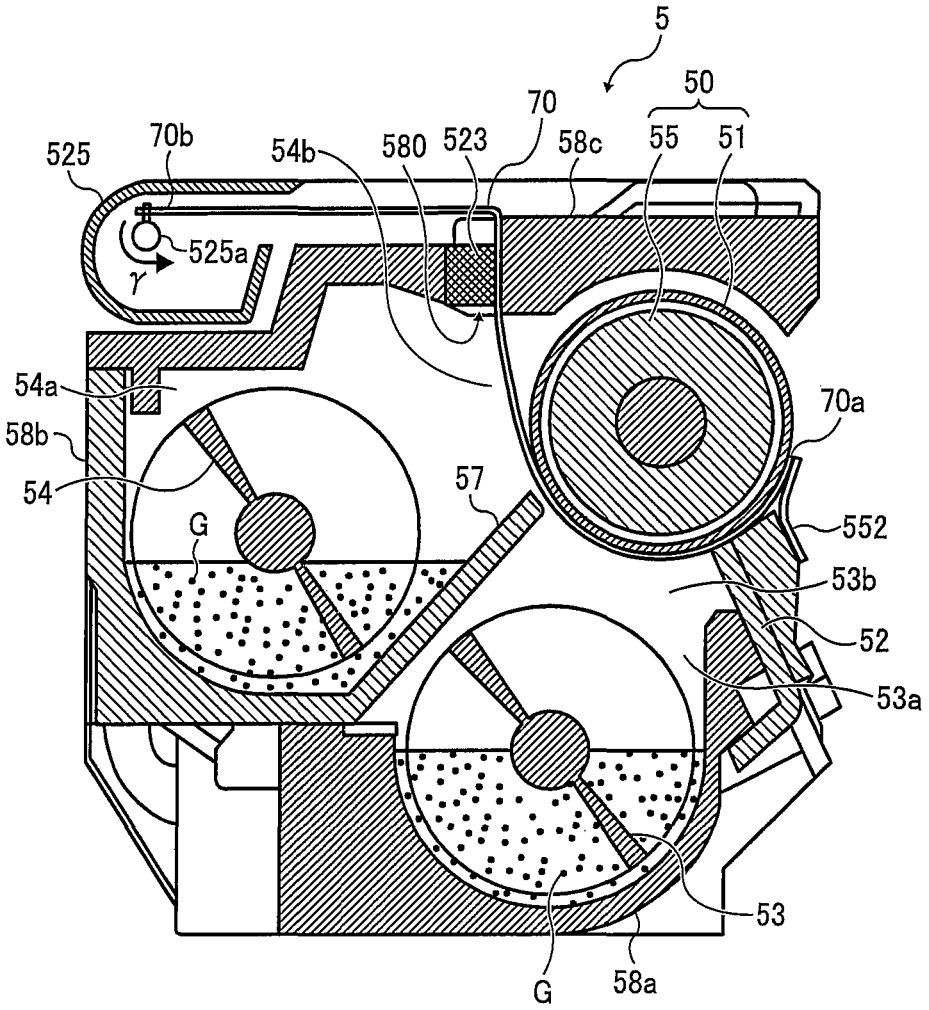
FIG. 9 is a cross-sectional view of a developing device before use, in which a reel device to reel a sealing sheet is provided, according to an embodiment.

Although the sealing sheet 70 is pulled out from the developing device 5 by users in the description above, alternatively, the sealing sheet 70 may be reeled in mechanically. FIG. 9 is a cross-sectional view of a configuration in which a reel device 525 to reel the sealing sheet 70 is provided in the developing device 5 before use.

In the state in which the developing device 5 shown in FIG. 9 is mounted in the image forming apparatus 500, a reel shaft 525*a* of the reel device 525 rotates in the direction indicated by arrow γ shown in FIG. 9 when a driving unit transmits driving force. Then, the sealing sheet 70 is mechanically reeled in and removed from the developing device 5, and developer can be supplied to the developing roller 50.

The reel device 525 is driven by the driving unit provided to the apparatus body of the image forming apparatus 500 and automatically stops after being driven for a predetermined period.

In the configuration shown in FIG. 1, when the developing device 5 or the image forming unit 6 serving as the process cartridge itself is transported, the sealing sheet 70 is removed outside the image forming apparatus 500, after which the developing device 5 or the image forming unit 6 is mounted in the apparatus. Then, the setup thereof is completed. However, to remove the sealing sheet 70 from the developing device 5 or the image forming unit 6 mounted in the apparatus body, it is necessary to dismount the developing device 5 or the image forming unit 6 from the apparatus body.

By contrast, the configuration shown in FIG. 9 can eliminate the necessary of dismounting the developing device 5 or the like to remove the sealing sheet 70 (i.e., a preset seal) since the reel device 525 can remove the sealing sheet 70 automatically or mechanically. This configuration can obviate manual work performed by the user before the developing device 5 is used, thus streamlining the work performed by the user.

Descriptions are given below of a configuration in which the developing device 5 further includes a sheet guide face 58*e* to guide the sealing sheet 70 with reference to FIGS. 10A, 10B, and 11. The sheet guide face 58*e* can be provided to the casing 58.

Figure 10A:
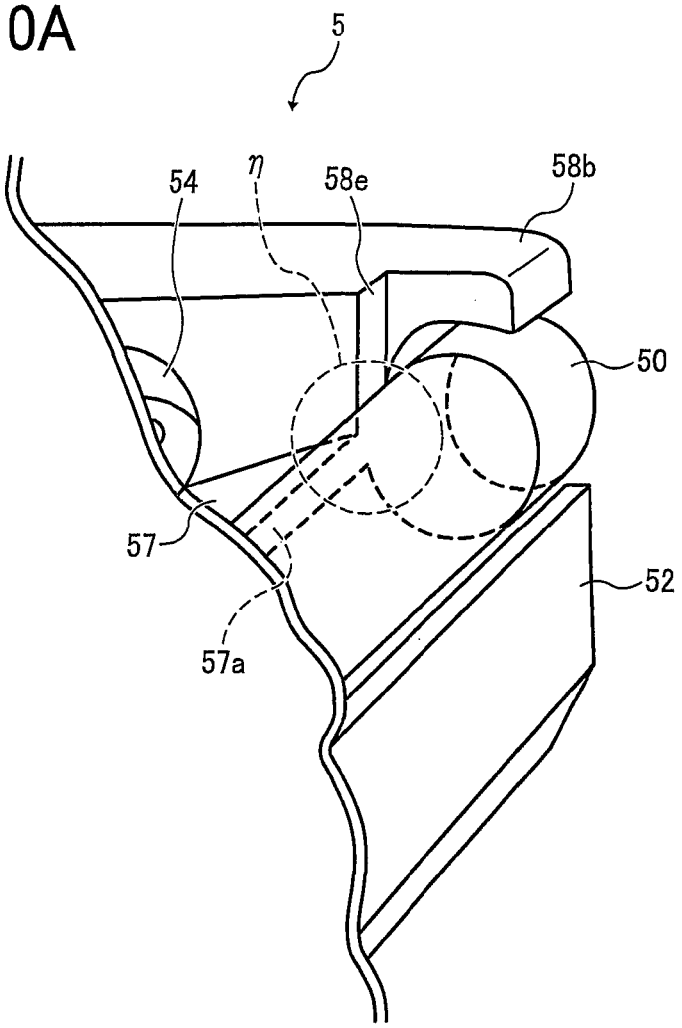
FIG. 10A is a perspective view of an axial end portion of a developing device according to an embodiment, including a sheet guide face, in a state in which the sealing sheet is removed from the developing device.
Figure 10B:
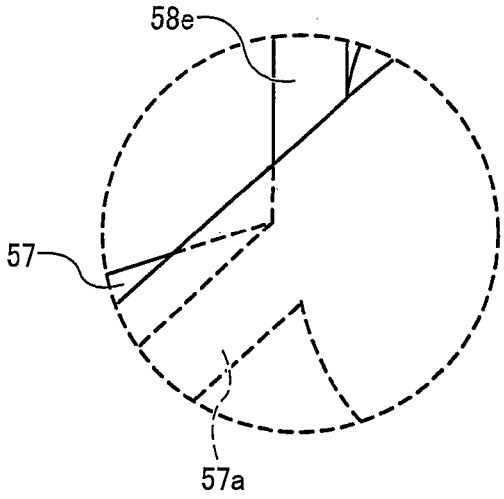
FIG. 10B is an enlarged view of an range shown in FIG. 10A.

FIGS. 10A and 10B illustrate a state in which the sealing sheet 70 is removed from the developing device 5 provided with the sheet guide face 58*e*. Specifically, FIG. 10A is a perspective view of an axial end portion of the developing device 5, and FIG. 10B is an enlarged view of a range η shown in FIG. 10A. FIG. 11 is a perspective view illustrating a state in which the sealing sheet 70 is in the developing device 5 provided with the sheet guide face 58*e*. It is to be noted that the development cover 58*c* and the development range entrance seal 552 are omitted in FIGS. 10A, 10B, and 11 for simplicity.

As shown in FIG. 10A, a clearance of about 0.1 mm to 0.6 mm is secured between the surface of the developing roller 50 and the end (in particular, the end face 57*a* shown in FIGS. 10A, 10B, and 11) of the partition 57 to inhibit the partition 57 from contacting the developing roller 50.

The sheet guide face 58*e* and the end of the partition 57*a* facing the developing roller 50 together form a continuous face. In particular, the sheet guide face 58*e* and the end face 57*a* form a continuous face in the configuration shown in FIGS. 10A, 10B, and 11. The sealing sheet 70 can move while being guided by the sheet guide face 58*e*, which can inhibit deformation, such as twist and crease, of the sealing sheet 70. Accordingly, shielding of the developing roller 50 from developer can be secured.

Figure 11:
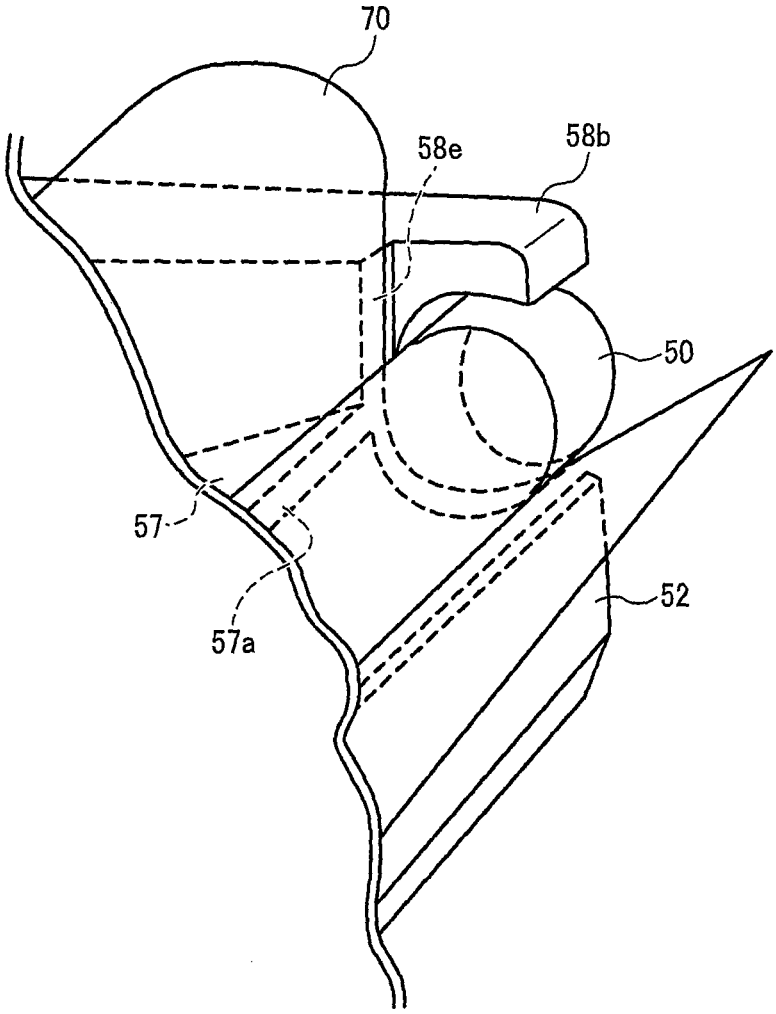
FIG. 11 is a perspective view illustrating a state in which the sealing sheet is in the developing device provided with the sheet guide face.

In the developing device 5 shown in FIGS. 10A, 10B, and 11, a portion of the sheet guide face 58*e* above the end face 57*a* of the partition 57 extends vertically upward from the end face 57*a*. A portion of the sheet guide face 58*e* lower than the end face 57*a* of the partition 57 is shaped to confirm to the circumference of the developing roller 50 across a clearance of the same or similar size as the clearance between the end face 57*a* and the surface of the developing roller 50. That is, over a range from the end face 57*a* to the doctor blade 52, the sheet guide face 58*e* has a shape conforming to the surface of the developing roller 50 with the distance between the sheet guide face 58*e* and the surface of the developing roller 50 kept identical or similar to the distance between the end face 57*a* and the surface of the developing roller 50.

Generally, the doctor gap is adjusted in assembling of the developing device 5 as follows. The developing roller 50 and the doctor blade 52 are mounted in the developing device 5, clearance of a constant size is secured using a tool such as a thickness gauge, and then those components are fixed inside the developing roller 50 with screws or the like. In this case, it is difficult to adjust the doctor gap with the sealing sheet 70 inserted in the doctor gap.

Concerning this inconvenience, the developing device 5 provided with the sheet guide face 58*e* is advantageous in that the sealing sheet 70 can be inserted from the side of the doctor gap or the side of the cover opening 580 after the adjusting. More specifically, the sealing sheet 70 is inserted from either the doctor gap or the cover opening 580 along the sheet guide face 58*e*, and the sealing sheet 70 can reach the other opening without being twisted or creased. Thus, the supply opening 53*b* and the collecting opening 54*b* can be sealed. Accordingly, the sealing sheet 70 can be disposed in the developing device 5 after the adjustment of the doctor gap.

In the present embodiment, the sealing sheet 70 is designed to be pulled by either end, namely, the lower end 70*a* or the upper end 70*b*, on a cross section perpendicular to the axial direction of the developing device 5 in removal of the sealing sheet 70 from the developing device 5. Although the sealing sheet 70 extending from the cover opening 580 to the doctor gap may be pulled out in a direction parallel to the axial direction, such a configuration requires an opening formed in a lateral side face of the casing 58 through which the sealing sheet 70 is pulled in a direction parallel to the axial direction. Accordingly, securing the strength of the casing 58 may be difficult. By contrast, the configuration in which the lower end 70*a* or the upper end 70*b* of the sealing sheet 70 is pulled can eliminate the necessity of forming another opening through which the sealing sheet 70 is pulled out in addition to the cover opening 580 and the doctor gap. This configuration can inhibit decreases in the strength of the casing 58.

In particular, in the present embodiment, the sealing sheet 70 is designed to be pulled from the upper end 70*b* in removal of the sealing sheet 70 from the developing device 5. Pulling the upper end 70*b* is advantageous in the configuration in which the developing device 5 and the photoreceptor 1 are united together into a modular unit (i.e., a process cartridge), and the sealing sheet 70 is removed in a state in which the modular unit is dismounted from the apparatus body. In such a configuration, the following inconvenience may arise when the sealing sheet 70 is pulled from the lower end 70*a* on the side of the doctor gap. Since the sealing sheet 70 is pulled on the side adjacent to the photoreceptor 1, there is a risk that a user's hand or the sealing sheet 70 contacts the surface of the photoreceptor 1, thereby damaging it. By contrast, pulling the sealing sheet 70 from the upper end 70*b* on the side opposite the doctor gap can inhibit damage to the photoreceptor 1, and the present embodiment can attain good usability in removal of the sealing sheet 70 through the cover opening 580.

Figure 12:
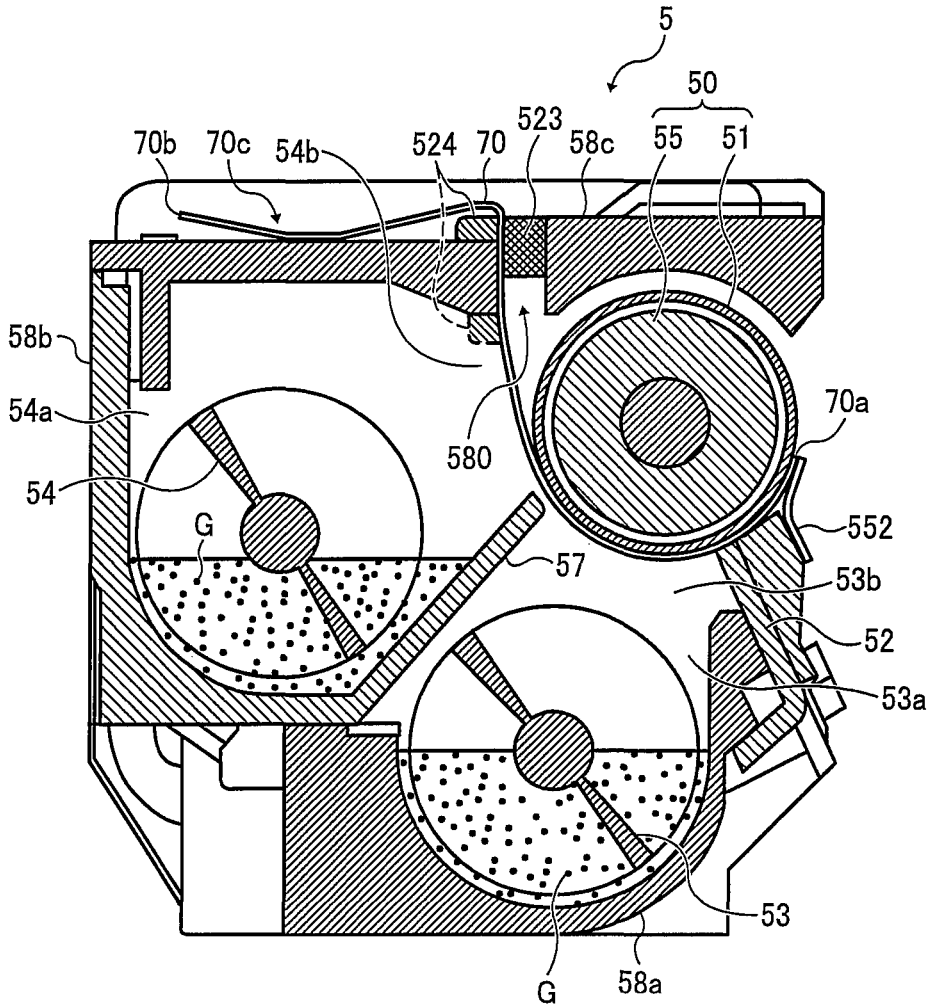
FIG. 12 is a cross-sectional view illustrating a position of a cover opening according to the first embodiment, different from the position of the cover opening in FIG. 1.

FIG. 12 is a cross-sectional view of a configuration in which the position of the cover opening 580 is shifted to the developing roller 50 from that in FIG. 1 and illustrates a state before use. In FIG. 12, the sealing member 523 is on the roller side of the sealing sheet 70 facing the developing roller 50. The sealing member 523 can seal the cover opening 580 and serve as a filter to allow passage of air to inhibit pressure rise inside the developing device 5 while blocking passage of developer.

In the developing device 5 shown in FIG. 12, since the sealing member 523 is on roller side (i.e., the first face) of the sealing sheet 70 facing the developing roller 50, the sealing member 523 does not contact the developer contained in the supply channel 53*a* and the collecting channel 54*a* with the sealing sheet 70 disposed in the developing device 5. In a configuration in which developer can contact the sealing member 523 with the sealing sheet 70 disposed in the developing device 5, there is a risk that developer adheres to the sealing member 523 and clogs the sealing member 523 serving as the filter during transport or storage before use of the developing device 5.

By contrast, the developing device 5 shown in FIG. 12 is advantageous in inhibiting clogging of the sealing member 523 (i.e., filter) since the sealing member 523 does not contact developer in the supply channel 53*a* and the collecting channel 54*a* in a state in which the sealing sheet 70 is disposed in the developing device 5.

The developing device 5 shown in FIG. 12 further includes a sheet cleaner 524 to wipe off developer adhering to the second face of the sealing sheet 70 opposite the developing roller 50. Since the sealing member 523 is on the roller side of the sealing sheet 70 facing the developing roller 50 in the arrangement shown in FIG. 12, the sealing member 523 does not wipe off the developer adhering to the second face of the sealing sheet 70. Instead, the sheet cleaner 524 can remove the developer adhering to the sealing sheet 70. Thus, scattering of developer can be inhibited.

The sheet cleaner 524 can be disposed either outside the development cover 58*c* as indicated by solid lines shown in FIG. 12 or inside the development cover 58*c* as indicated by broken lines shown in FIG. 12.

Second Embodiment

Descriptions are given below of a second embodiment in which the sealing member 523 is not provided to the cover opening 580 and the sheet cleaner 524 seals the cover opening 580 after removal of the sealing sheet 70. Thus, the sheet cleaner 524 serves as the opening sealing member.

Figure 13:
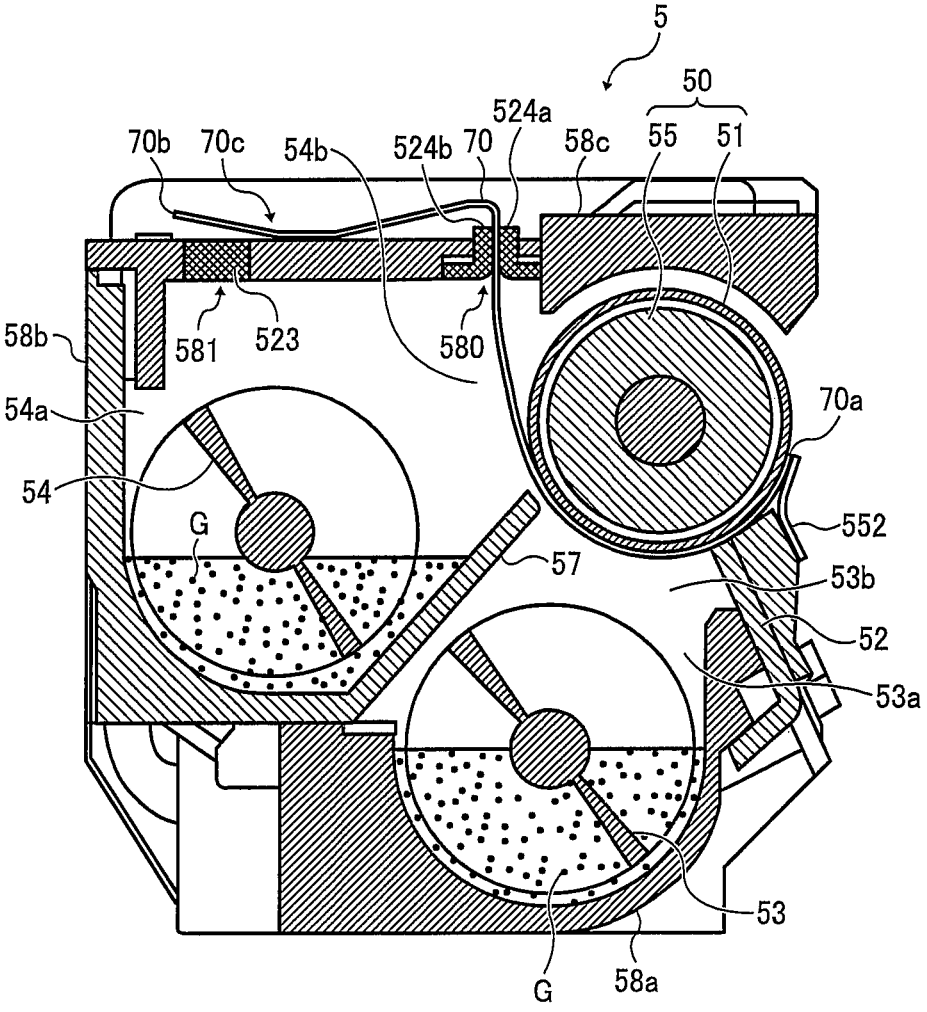
FIG. 13 is a cross-sectional view of a developing device before use, according to a second embodiment.
Figure 14:
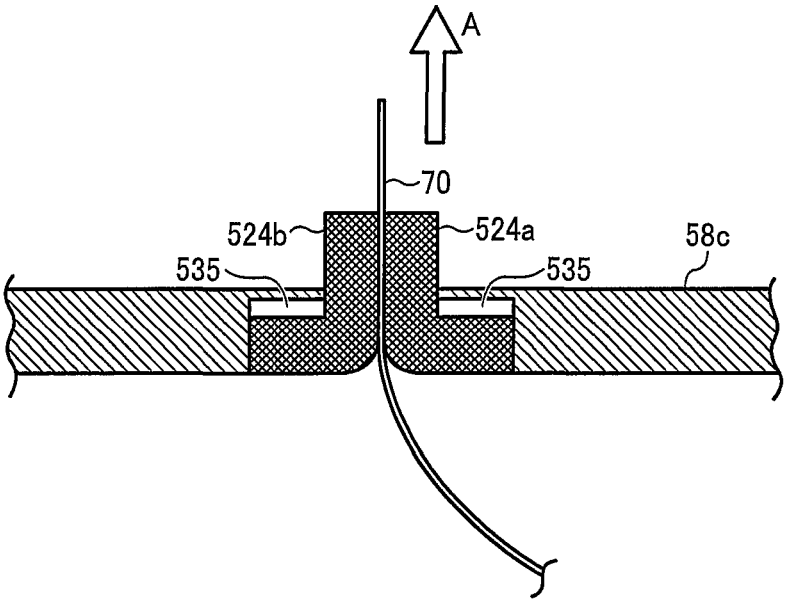
FIG. 14 is an enlarged cross-sectional view illustrating an area adjacent to a sheet cleaner in the developing device according to the second embodiment.

FIG. 13 is a cross-sectional view of a configuration according to the second embodiment, and FIG. 14 is an enlarged cross-sectional view illustrating an area adjacent to the sheet cleaner 524 in the developing device 5 shown in FIG. 13. In FIG. 14, arrow A indicates the direction (hereinafter "direction A") in which the sealing sheet 70 is pulled out.

In the developing device 5 shown in FIG. 13, a pressure-release opening 581 is formed in the development cover 58*c* separately from the cover opening 580, and the sealing member 523 serving as the filter is provided to the pressure-release opening 581. The developing device 5 shown in FIGS. 13 and 14 includes first and second cleaning members 524*a* and 524*b* disposed across the sealing sheet 70 from each other. The first and second cleaning members 524*a* and 524*b* together form a sheet cleaner to clean the sealing sheet 70. The first cleaning member 524*a* is on the side of the developing roller 50.

The two cleaning members 524*a* and 524*b* are disposed at a mouth enclosing the cover opening 580 in the development cover 58*c*. As the sealing sheet 70 being pulled up passes through the cover opening 580, the cleaning members 524*a* and 524*b* contact the respective faces of the sealing sheet 70, thereby cleaning the sealing sheet 70.

The two cleaning members 524*a* and 524*b* sandwich the sealing sheet 70. For example, each of the cleaning members 524*a* and 524*b* can be an elastic planar member bonded to the development cover 58*c* via an adhesive face 535. The two cleaning members 524*a* and 524*b* facing each other across the sealing sheet 70 are planar elastic members. In the configuration shown in FIG. 14, the cleaning members 524*a* and 524*b* are each fixed to the development cover 58*c* with the adhesive face 535 and bent at the position of the cover opening 580 into an L-shape. Free ends of the cleaning members 524*a* and 524*b* extend vertically upward. Additionally, the two cleaning members 524*a* and 524*b* are arranged to press against each other due to resilience thereof to become planar from the L-shaped bent state.

The cleaning members 524*a* and 524*b* are bent in the direction arrow A in which the sealing sheet 70 is pulled out, and the free ends thereof project from the development cover 58*c* in the direction A.

When the sealing sheet 70 is pulled from above the casing 58 as in the configuration shown in FIG. 1, it is possible that, due to friction force generated between the sealing sheet 70 being pulled and the upper portion (i.e., the development cover 58*c*) of the casing 58, upward force acts on the development cover 58*c*. Accordingly, the development cover 58*c* deforms with its axial center portion lifted. As a result, also the member (i.e., sealing member 523 in FIG. 1 or sheet cleaner 524 in FIG. 12) fixed adjacent to the cover opening 580 to clean the sealing sheet 70 deforms. If the sheet cleaner (523 or 524) deforms, a part of the sheet cleaner fails to contact the sealing sheet 70. Accordingly, a part of the sealing sheet 70 in the axial direction is not cleaned.

To clean the entire sealing sheet 70 in the axial direction, the pressure with which the sheet cleaner presses against the sealing sheet 70 may be increased. Increasing the pressing force, however, increases the friction force, and accordingly the sheet cleaner disposed adjacent to the cover opening 580 deforms. Consequently, the sealing sheet 70 is cleaned partly not entirely in the axial direction.

Further, if the mouth of the development cover 58*c* forming the cover opening 580 deforms, clearance is created after the sealing sheet 70 is removed. In this state, developer can scatter outside the casing 58.

In the configuration in which the sheet member is pulled in the axial direction, the amount of deformation at the mouth of the development casing is smaller, and the above-described defective cleaning is less likely to arise. In unidirectional circulation-type developing devices such as one shown in FIG. 1, however, layout limitations make it difficult to adopt the configuration in which the sheet member is pulled out from the axial end at which the amount of deformation is smaller. Therefore, an opening is formed in the wall parallel to the axial direction to pull out the sheet member. Since such an opening is long on the axial direction, the mouth is more likely to deform.

By contrast, in the developing device 5 according to the second embodiment, in removal of the sealing sheet 70, even if the development cover 58*c* deforms to create clearance between the sealing sheet 70 and the development cover 58*c*, either both or one of the two cleaning members 524*a* and 524*b* falls to the other cleaning member at the clearance. Thus, the clearance created by the deformed development cover 58*c* can be eliminated, thus securing the state in which the two cleaning members 524*a* and 524*b* sandwich the sealing sheet 70 therebetween. The contact between the sealing sheet 70 and the two cleaning members 524*a* and 524*b* can be maintained over the entire range in the axial direction. Therefore, developer adhering to the sealing sheet 70 can be removed uniformly.

In addition, the free ends of the two cleaning members 524*a* and 524*b* extend in the direction A in which the sealing sheet 70 is pulled. Further, the two cleaning members 524*a* and 524*b* press against each other due to its resilience to become planar. With these features, the two cleaning members 524*a* and 524*b* fall against each other toward the clearance created after the sealing sheet 70 is removed, and eliminate the clearance. Accordingly, developer can be inhibited from leaking from the cover opening 580 after the sealing sheet 70 is removed. Thus, the cleaning members 524*a* and 524*b* can serve as the opening sealing member.

For the sheet cleaner 524, any of typical sealing materials, such as polyurethane, can be used. However, even typically used as sealing materials, materials, such as UBT (soft urethane foam of minute cell structure) from Bridgestone Corporation, that have poor resistance to sliding contact are not desirable. Such materials wear and result in clearance after the sealing sheet 70 is removed. It is to be noted that UBT excels in sealing capability (in particular, the capability of sealing in fine substances such as toner) and sound-proof capability due to its low permeability and very fine cell structure.

Figure 15:
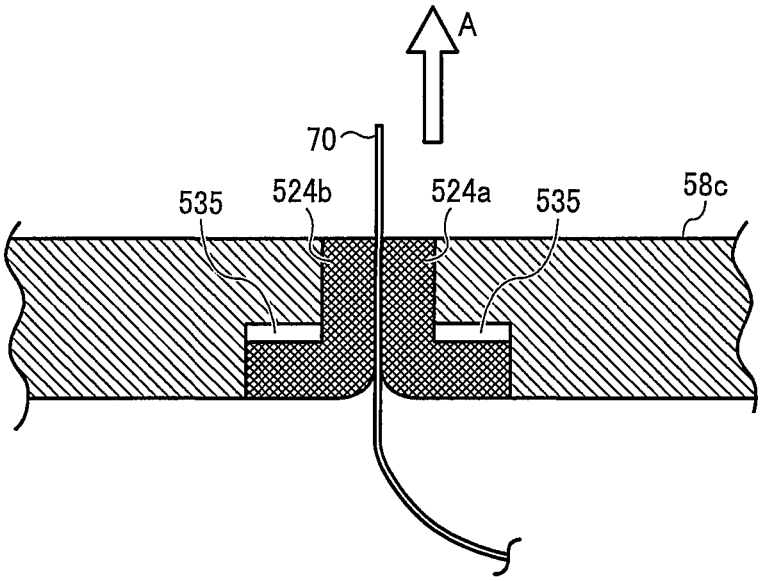
FIG. 15 is an enlarged cross-sectional view illustrating a configuration that is different in relations between the thickness of a development cover and a free end length of the sheet cleaner from the configuration shown in FIG. 14.

It is to be noted that the arrangement of the cleaning members 524*a* and 524*b* bent into the L-shape is not limited to the arrangement shown in FIG. 14 in which the free ends of the cleaning members 524*a* and 524*b* project from the development cover 58*c* in the direction A. Alternatively, as long as the free ends of the cleaning members 524*a* and 524*b* project beyond the adhesive faces 535 in the direction A in which the sealing sheet 70 is pulled as shown in FIG. 15, it is not necessary those free ends project from the development cover 58*c*. With this arrangement, due to resilience thereof to become planar from the bent state, the two cleaning members 524*a* and 524*b* press against each other and seal the clearance even if the development cover 58*c* deforms.

Additionally, in the arrangement in which the two cleaning members 524*a* and 524*b* sandwich the sealing sheet 70, the two cleaning members 524*a* and 524*b* may be different in material. In this case, it is desirable that the first cleaning member 524*a* is formed of a material slidable on the sealing sheet 70 and the second cleaning member 524*b* is formed of a material having a good capability to clean the sealing sheet 70. The first cleaning member 524*a* faces the first face of the sealing sheet 70 opposed to the developing roller 50, and toner does not contact the first face of the sealing sheet 70. Accordingly, the necessity of cleaning the first face in removal of the sealing sheet 70 is smaller. When the material having a good slidability is used, sliding load in removal of the sealing sheet 70 can be reduced, and operability can improve.

By contrast, the second cleaning member 524*b* contacts the second face of the sealing sheet 70 that contacts developer, and the second cleaning member 524*b* is required to clean the second face in removal of the of the sealing sheet 70. When the material having a good cleaning capability is used for the second cleaning member 524*b*, removal of developer from the sealing sheet 70 can be secured, and scattering of developer can be inhibited better.

Third Embodiment

Descriptions are given below of a third embodiment in which the angle at which the sheet cleaner 524 is attached to the development cover 58*c* is different from that in the second embodiment. Descriptions of features similar to those of the above-described embodiments are omitted.

Figure 16:
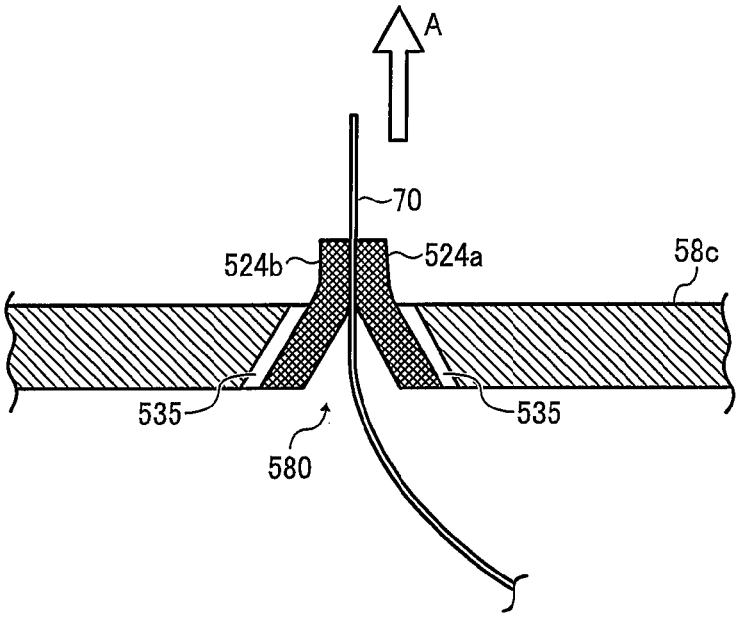
FIG. 16 is an enlarged cross-sectional view illustrating an area adjacent to the sheet cleaner in the developing device according to a third embodiment.

FIG. 16 is an enlarged cross-sectional view illustrating an area adjacent to the sheet cleaner 524 provided to the development cover 58*c* in the third embodiment. In FIG. 16, arrow A indicates the direction in which the sealing sheet 70 is pulled out.

In the third embodiment, the sheet cleaner is constructed of the two cleaning members 524*a* and 524*b* provided to the development cover 58*c* and facing each other, between which the sealing sheet 70 passes.

Additionally, inclined adhesive faces 535 are provided adjacent to the cover opening 580 formed in the development cover 58*c*, and the two cleaning members 524*a* and 524*b* are fixed to the development cover 58*c* via the adhesive faces 535. Each of the cleaning members 524*a* and 524*b* is bent milder than an L-shape, that is, at an angle greater than 90 degrees, at the cover opening 580. The free ends of the cleaning members 524*a* and 524*b* extend vertically upward. Additionally, the two cleaning members 524*a* and 524*b* are arranged to press against each other due to the resilience to become planar from the bent state. Further, the cleaning members 524*a* and 524*b* are bent in the direction arrow A in which the sealing sheet 70 is pulled out, and their free ends project from the development cover 58*c* in the direction A.

In the third embodiment, the two cleaning members 524*a* and 524*b* are fixed to the development cover 58*c* via the inclined adhesive faces 535, and developer is wiped off by the portions of the cleaning members 524*a* and 524*b* projecting from the development cover 58*c*. This configuration can alleviate the friction force generated between the sealing sheet 70 and the cleaning members 524*a* and 524*b*, thus improving the operability in removal of the sealing sheet 70.

The two cleaning members 524*a* and 524*b* face each other with the sealing sheet 70 interposed between them similarly to the second embodiment. Accordingly, the two cleaning members 524*a* and 524*b* contact the respective faces of the sealing sheet 70 without clearance over the entire axial length. Therefore, developer adhering to the sealing sheet 70 can be removed uniformly.

In addition, the free ends of the two cleaning members 524*a* and 524*b* extend in the direction A in which the sealing sheet 70 is pulled. Additionally, the two cleaning members 524*a* and 524*b* are fixed to the development cover 58*c* via the inclined adhesive faces 535 to press against each other due to resilience thereof from the bent state. With these features, the two cleaning members 524*a* and 524*b* fall against each other, toward the clearance created after the sealing sheet 70 is removed, and eliminate the clearance. Accordingly, developer can be inhibited from leaking from the cover opening 580 after the sealing sheet 70 is removed.

Fourth Embodiment

Although the lower end 70*a* of the sealing sheet 70 overlaps the end portion of the development range entrance seal 552 in the above-described first to third embodiment, in a fourth embodiment described below, the sealing sheet 70 is disposed so that an end portion including the lower end 70*a* is curved into a curved portion 70*d* that is U-shaped or hairpin-shaped downstream from the doctor gap in the direction of rotation of the developing roller 50.

Figure 17:
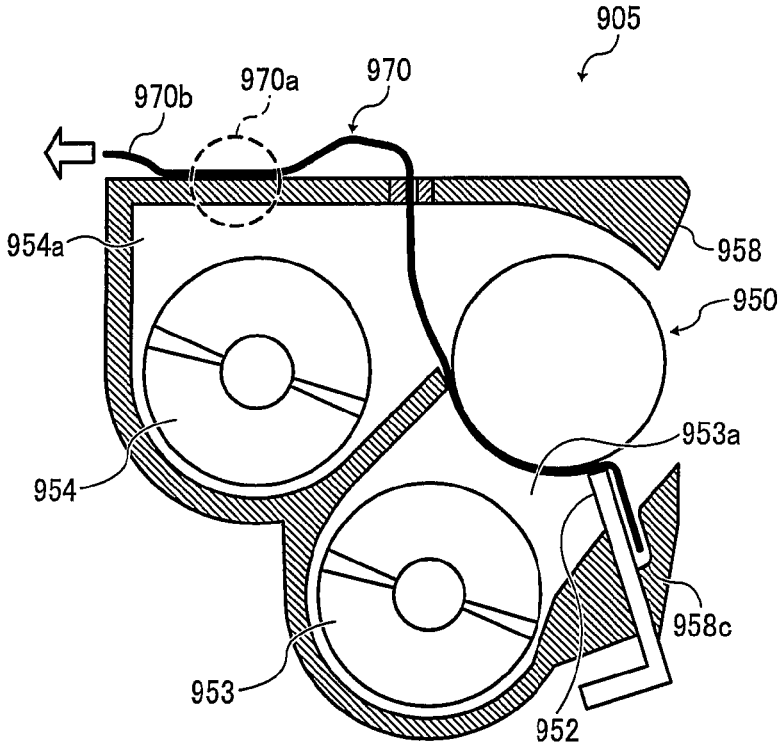
FIG. 17 is a schematic diagram of a comparative developing device.

FIG. 17 illustrates a comparative developing device 905.

A casing 958 of the developing device 905 holds a developing roller 950, a doctor blade 952, a supply screw 953, and a collecting screw 954. Inside the casing 958, developer is contained in a supply channel 953*a* provided with the supply screw 953 and a collecting channel 954*a* provided with the collecting screw 954.

As the supply screw 953 rotates, developer is supplied from the supply channel 953*a* to the developing roller 950 and passes through the doctor gap. Developer collected from the developing roller 950 is transported by the collecting screw 954 and forwarded from the collecting channel 954*a* through an opening at the axial end to the supply channel 953*a*.

The comparative developing device 905 is shipped with a sealing sheet 970 installed therein. The sealing sheet 970 includes a welded portion 970*a* welded to an upper face of the casing 958. The welded portion 970*a* is slightly shifted from a railing end 970*b* (i.e., an upper end in FIG. 17) to the other end (i.e., a leading end or a lower end) of the sealing sheet 970. The leading end of the sealing sheet 970 is put inside the casing 958 through a clearance formed in an upper wall of the casing 958. The sealing sheet 970 passes sequentially between the collecting channel 954*a* and the developing roller 950, between the supply channel 953*a* and the developing roller 950, and the doctor gap. Then, the leading end of the sealing sheet 970 is inserted into a recess 958*c* formed in the casing 958 and thus supported by the casing 958.

The user picks up the trailing end 970*b* of the sealing sheet 970 and peels off the welded portion 970*a* from the casing 958. The user pulls out the sealing sheet 970 upward from the developing device 905, thereby enabling supply of developer to and collection of developer from the developing roller 950.

In the configuration shown in FIG. 17, however, there is a risk that developer leaks from the supply channel 953*a* or the collecting channel 954*a* upon vibration or impact during transport. Specifically, the sealing sheet 970 is kept taut inside the developing device 905. The sealing sheet 970 in this state can strongly adhere to the end of the doctor blade 952 and seals the supply channel 953*a*. At that time, although the leading end of the sealing sheet 970 is pulled to the trailing side due to the tension, friction force can retain the leading end of the sealing sheet 970 inside the recess 958*c*. However, the friction force decreases to allow the leading end to move out the recess 958*c* to the trailing side upon vibration or impact during transport. If the sealing sheet 970 moves and is slackened, clearance is created between the sealing sheet 970 and the doctor blade 952. Then, developer in the supply channel 953*a* can leak from the clearance.

When the sealing sheet 970 is pulled out from the casing 958, the sealing sheet 970 welded to the casing 958 may be peeled off therefrom. In the comparative developing device 905 shown in FIG. 17, if the leading end of the sealing sheet 970 is welded to the inner face of the casing 958, the leading end of the sealing sheet 970 can be retained at the predetermined position regardless of vibration and impact during transport. Although leak of developer during transport can be prevented with this configuration, the surface of the developing roller 950 may be damaged when the sealing sheet 970 is pulled out.

Specifically, as shown in FIG. 17, the sealing sheet 970 partly winds around the developing roller 950 adjacent to the doctor gap. If the leading end of the sealing sheet 970 in this state is welded to the casing 958, relatively strong force is required to peel the welded leading end thereof from the casing 958 in removal of the sealing sheet 970. At that time, there is a risk that the sealing sheet 970 is rubbed strongly against the developing roller 950, thus damaging the surface thereof.

It is to be noted that the sealing sheet is welded to a given welding section as follows for convenience. The welded portion of the sealing sheet is kept in close contact with the welding section, and the entire welded portion is welded to the welding section with a heating tool (e.g., an iron,) pressed against the welded portion.

Figure 18:
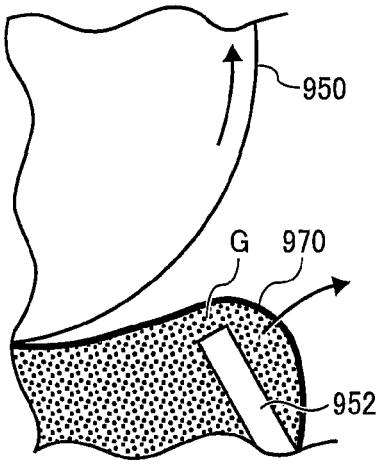
FIG. 18 is an enlarged view illustrating leak of developer from the developing device shown in FIG. 17.

Although damage to the developing roller 50 can be avoided by inserting the leading end of the sealing sheet 970 in the recess 958*c* of the casing 958 instead of welding it to the casing 958, as described above, it is possible that the leading end of the sealing sheet 970 inside the recess 958*c* moves to the trailing side upon vibration or impact during transport. Then, as the sealing sheet 970 goes slack, as shown in FIG. 18, clearance is created between the sealing sheet 970 and the end of the doctor blade 952, thereby allowing developer to scatter outside.

Next, a feature of the fourth embodiment is described in further detail below.

Figure 19:
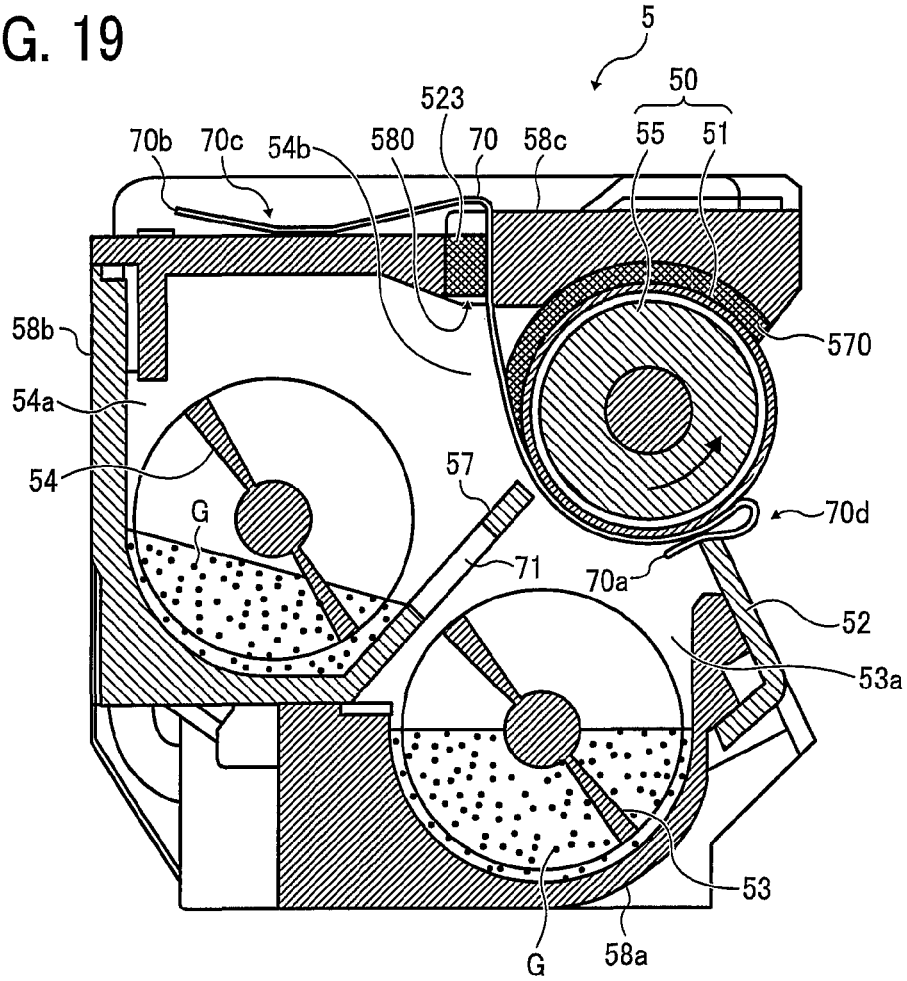
FIG. 19 is a cross-sectional view of a developing device according to a fourth embodiment before shipment.

FIG. 19 is a cross-sectional view of the developing device 5 according to the fourth embodiment before shipment.

The developing device 5 shown in FIG. 19 is shipped with the sealing sheet 970 installed therein. The sealing sheet 70 includes a welded portion 70*c* welded to the upper face of the casing 58. The welded portion 70*c* is slightly shifted from the upper end (or trailing end) 70*b* to the leading side (i.e., the lower end 70*a*) of the sealing sheet 70. The leading side of the sealing sheet 970 is put inside the casing 58 through a clearance formed in the upper wall of the casing 58. The sealing sheet 70 passes sequentially between the collecting channel 54*a* and the developing roller 50, between the supply channel 53*a* and the developing roller 50, and the doctor gap. Then, the leading end 70*a* of the sealing sheet 70 exits the developing device 5.

The sealing sheet 70 is kept taut inside the casing 58, and thus the sealing sheet 70 adheres to the end of the doctor blade 52 and that of the partition 57 without clearance, thereby sealing in developer in the supply compartment 53*a* and the collecting compartment 54*a*. The user picks up the trailing end 70*b* of the sealing sheet 70 and peels the welded portion 70*c* from the casing 58 (the development cover 58*c* in particular). The user pulls out the sealing sheet 70 upward from the casing 58, thereby enabling supply of developer to and collection of developer from the developing roller 50.

Figure 20:
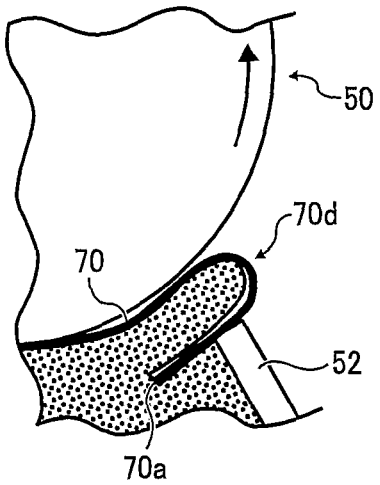
FIG. 20 is an enlarged view illustrating the doctor gap and the adjacent portion in the developing device shown in FIG. 19.

FIG. 20 is an enlarged view illustrating the doctor gap and the adjacent portion in the developing device 5 according to the fourth embodiment.

In FIG. 20, an arrow indicates the direction of rotation of the developing roller 50. The leading end portion of the sealing sheet 70 including the leading end 70*a* is curved, thus forming the curved portion 70*d* shaped like a character "U" or hairpin downstream from the doctor gap in the direction of rotation of the developing roller 50. Due to the resilience of the curved portion 70*d* returning to a straight posture, a portion of the sealing sheet 70 shifted from the curved portion 70*d* to the leading end 70*a* is pressed against the end of the doctor blade 52. Being thus pressed, the leading end portion of the sealing sheet 70 exerts a relatively great friction force on the end of the doctor blade 52. Additionally, due to the resilience of the curved portion 70*d*, the portion of the sealing sheet 70 slightly posterior to the curved portion 70*d* is pressed against the developing roller 50 and exerts a relatively great friction force on the developing roller 50. With these friction forces, the leading end portion of the sealing sheet 70 is strongly retained at the end of the doctor blade 52.

In this configuration, the leading end portion of the sealing sheet 70 is retained more steadily at the predetermined position than in the configuration in which the leading end portion is inserted in the recess 958*c* as shown in FIG. 17. This configuration can inhibit the leading end portion of the sealing sheet 70 from moving to the trailing end upon vibration or impact during transport, thereby inhibiting leak of developer. Additionally, the force to retain the leading end portion of the sealing sheet 70 by pressing the leading end portion against the casing 58 or the like can be smaller than that in the configuration in which the leading end portion is welded thereto. Accordingly, the sliding force between the sealing sheet 70 and the developing roller 50 in removal of the sealing sheet 70 can be smaller, thus suppressing damage to the developing roller 50.

Fifth Embodiment

Figure 21:
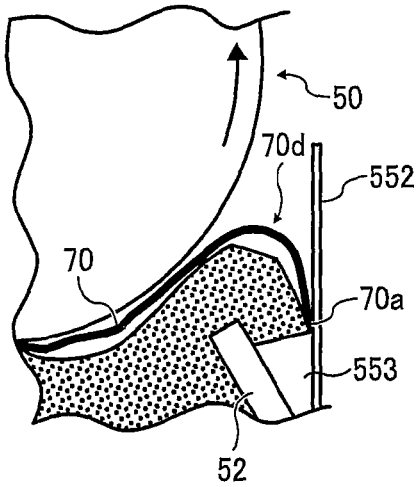
FIG. 21 is an enlarged view illustrating the doctor gap and the adjacent portion in a developing device according to a fifth embodiment.

FIG. 21 is an enlarged view illustrating the doctor gap and the adjacent portion in the developing device 5 according to a fifth embodiment that is partly different from the configuration shown in FIGS. 19 and 20.

The developing device 5 shown in FIG. 21 includes the development range entrance seal 552 to inhibit scattering of toner (i.e., developer) outside the developing device 5 from the supply compartment 53*a*. A supporter 553 to support the development range entrance seal 552 is fixed to an outer face (right side in FIG. 21) of the doctor blade 52 on the outer side of the developing device 5. The development range entrance seal 552 is cantilevered by the supporter 553.

The development range entrance seal 552 is designed to seal the doctor gap with its free end pressed against the circumferential surface of the developing roller 50, thereby inhibiting scattering of toner. In FIG. 21, however, the free end of the development range entrance seal 552 is not pressed against the developing roller 50 since the development range entrance seal 552 is deflected to the photoreceptor 1 (shown in FIG. 3) from its original posture by the leading end portion of the sealing sheet 70.

Similarly to the fourth embodiment, the leading end portion of the sealing sheet 70 is curved, thus forming the U-shaped (hairpin-shaped) curved portion 70*d* downstream from the doctor gap in the direction of rotation of the developing roller 50. However, the portion anterior to the curved portion 70*d* does not enter the doctor gap but is disposed outside the developing device 5. More specifically, due to the resilience of the curved portion 70*d* returning to the straight posture, the portion anterior to the curved portion 70*d* is pressed against a base portion of the development range entrance seal 552. With the sealing sheet 70 pressing thereon, the development range entrance seal 552 is deflected toward the photoreceptor 1 from its original posture. Simultaneously, being pressed, the leading end portion anterior to the curved portion 70*d* exerts a relatively great friction force on the development range entrance seal 552. Additionally, due to the resilience of the curved portion 70*d*, the portion of the sealing sheet 70 slightly posterior to the curved portion 70*d* is pressed against the developing roller 50 and exerts a relatively great friction force on the developing roller 50. With these friction forces, the leading end portion of the sealing sheet 70 is strongly retained at the base position of the development range entrance seal 552.

In this configuration as well, the leading end portion of the sealing sheet 70 is retained more steadily at the predetermined position than in the configuration in which the leading end portion is inserted in the recess 958*c* as shown in FIG. 17. The configuration shown in FIG. 21 can inhibit the leading end portion of the sealing sheet 70 from moving to the trailing end upon vibration or impact during transport, thereby inhibiting leak of developer. Additionally, the force to retain the leading end portion of the sealing sheet 70 by pressing the leading end portion against the casing 58 or the like can be smaller than that in the configuration in which the leading end portion is welded thereto. Thus, damage to the developing roller 50 in removal of the sealing sheet 70 can be inhibited.

It is to be noted that, when the sealing sheet 70 is removed from the developing device 5, the development range entrance seal 552 is no longer pressed by the leading end portion of the sealing sheet 70, and the development range entrance seal 552 reverts to the original posture from the deflected posture. Then, the free end of the development range entrance seal 552 contacts the developing roller 50.

Sixth Embodiment

Figure 22:
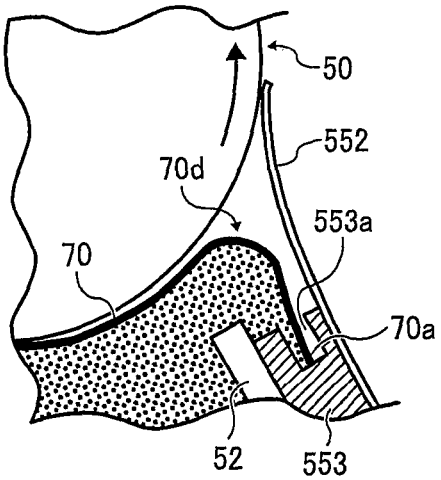
FIG. 22 is an enlarged view illustrating the doctor gap and the adjacent portion in a developing device according to a sixth embodiment.

FIG. 22 is an enlarged view illustrating the doctor gap and the adjacent portion in the developing device 5 according to a sixth embodiment.

The developing device 5 shown in FIG. 22 also includes the development range entrance seal 552 to inhibit scattering of toner outside the developing device 5 from the supply compartment 53*a*. The free end of the development range entrance seal 552 contacts the developing roller 50, thereby sealing the doctor gap.

A retaining recess 553*a* is formed in the supporter 553 by which the development range entrance seal 552 is cantilevered. The leading end portion of the sealing sheet 70 including the leading end 70*a* is curved, thus forming the curved portion 70*d* shaped like a character "U" or hairpin downstream from the doctor gap in the direction of rotation of the developing roller 50. A portion anterior to the curved portion 70*d* is inserted into the retaining recess 553*a* formed in the supporter 553 and pressed against an inner face inside the retaining recess 553*a* due to the resilience of the curved portion 70*d* returning to a straight posture. Being thus pressed, the leading end portion of the sealing sheet 70 anterior to the curved portion 70*d* exerts a relatively great friction force on the inner face of the retaining recess 553*a*. Additionally, due to the resilience of the curved portion 70*d*, the portion of the sealing sheet 70 slightly posterior to the curved portion 70*d* is pressed against the developing roller 50 and exerts a relatively great friction force on the developing roller 50. With these friction forces, the leading end portion of the sealing sheet 70 is strongly retained adjacent to the retaining recess 553*a*.

In this configuration as well, the leading end portion of the sealing sheet 70 is retained more steadily at the predetermined position than in the configuration shown in FIG. 17. This configuration can inhibit the leading end portion of the sealing sheet 70 from moving to the trailing end upon vibration or impact during transport, thereby inhibiting leak of developer. Additionally, the force to retain the leading end portion of the sealing sheet 70 by pressing the leading end portion against the casing 58 or the like can be smaller than that in the configuration in which the leading end portion is welded thereto. Thus, damage to the developing roller 50 in removal of the sealing sheet 70 can be inhibited.

Seventh Embodiment

Next, a seventh embodiment is described below. Other than the differences described below, the developing device 5 according to the seventh embodiment is similar to the above-described embodiments.

Figure 23:
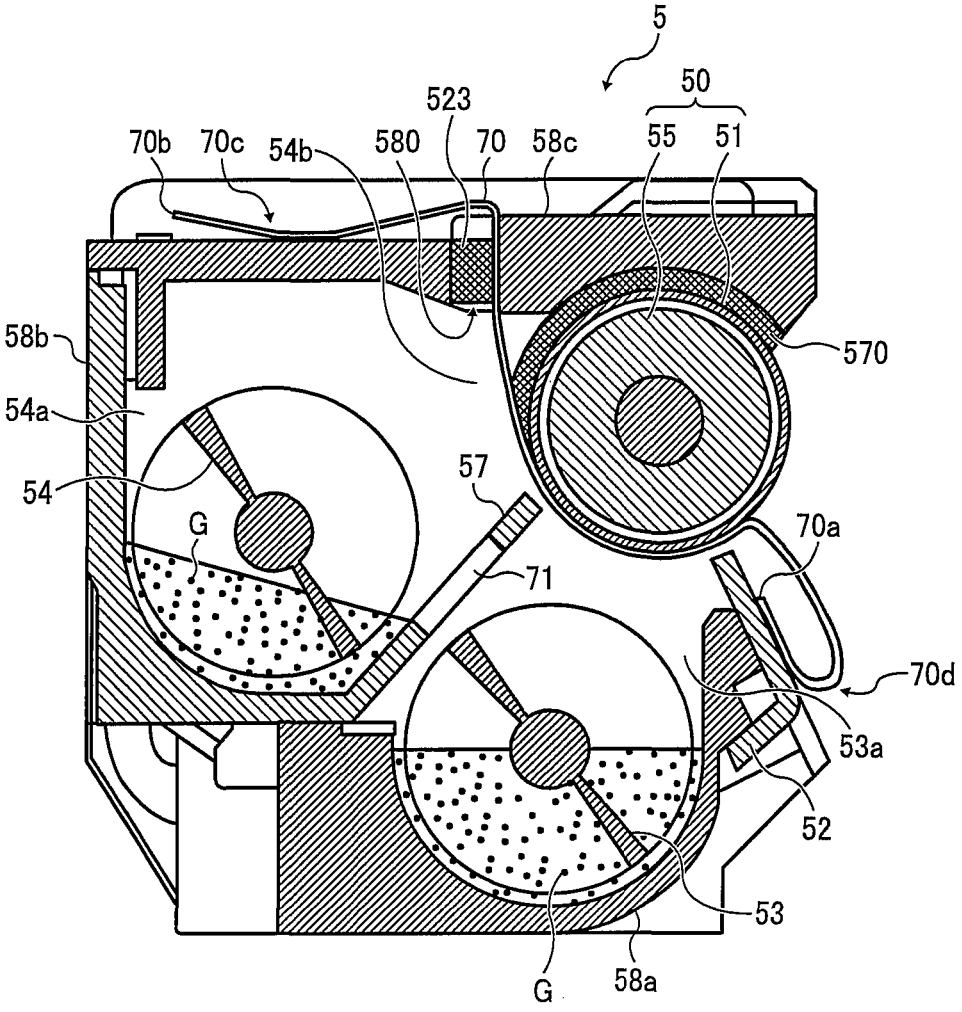
FIG. 23 is a cross-sectional view of a developing device according to a seventh embodiment before shipment.

FIG. 23 is a cross-sectional view of the developing device 5 according to the seventh embodiment before shipment.

The leading end portion of the sealing sheet 70 including the leading end 70*a* is curved, thus forming the curved portion 70*d* shaped like a character "U" or hairpin downstream from the doctor gap in the direction of rotation of the developing roller 50. A portion of the sealing sheet 70 anterior to the curved portion 70*d* in the insertion direction of the sealing sheet 70 is in contact with the face of the doctor blade 52 on the outer side of the developing device 5.

Figure 24:
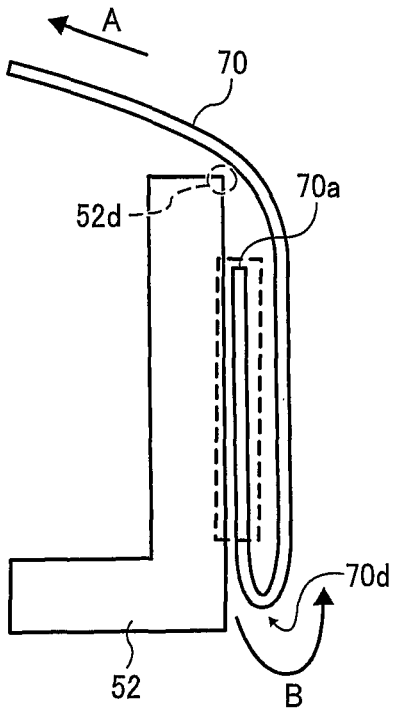
FIG. 24 is an enlarged view illustrating the doctor blade and the adjacent portion in the developing device shown in FIG. 23.

FIG. 24 is an enlarged schematic diagram illustrating the doctor blade 52 and the adjacent portion of the developing device 5 according to the seventh embodiment.

On the leading side of the sealing sheet 70, an area enclosed by alternate long and short dashed lines in FIG. 24 is in contact with the doctor blade 52. In welding of the sealing sheet 70, conventionally the entire contact area is welded. However, a relatively strong force is required to peel off the sealing sheet 70 welded in this matter. Accordingly, the sealing sheet 70 is pulled out strongly, which increases the possibility that the developing roller 50 is damaged by the sealing sheet 70 rubbed thereon.

Therefore, in the seventh embodiment, the welded area of the sealing sheet 70 is reduced. That is, a part of the contact area with the doctor blade 52 on the leading end side of the sealing sheet 70 is welded. With this configuration, the sealing sheet 70 can be pulled out with a weaker force compared with the configuration in which the entire contact area is welded, and damage to the developing roller 50 in removal of the sealing sheet 70 can be inhibited. Additionally, the end portion of the sealing sheet 70 partly welded can be retained on the face of the doctor blade 52 more securely compared with the configuration in which the leading end portion is inserted as shown in FIG. 17. This configuration can inhibit the leading end portion of the sealing sheet 70 from moving to the trailing side upon vibration or impact during transport, thereby inhibiting leak of developer.

As shown in FIG. 24, the portion adjacent to the leading end 70*a* of the sealing sheet 70 forms the curved portion 70*d* and U-turns in the direction A, toward the trailing side. With the leading end 70*a* oriented to the trailing end 70*a* (shown in FIG. 23), the portion anterior to the curved portion 70*d* is partly welded to the face of the doctor blade 52. In FIG. 24, arrow A indicates the direction in which the sealing sheet 70 is pulled out. As the trailing end portion of the sealing sheet 70 is pulled in the direction A, the curved portion 70*d* receives a force in the direction, indicated by arrow B in FIG. 24, to move away from the face of the doctor blade 52. With this configuration, the welded portion of the sealing sheet 70 can be peeled from the doctor blade 52 with a weaker force compared with a case in which the leading end portion of the sealing sheet 70 that is partly welded is not curved or turned. Accordingly, damage to the developing roller 50 in removal of the sealing sheet 70 can be inhibited better.

To partly weld the contact area on the leading side of the sealing sheet 70 to the doctor blade 52, for example, the sealing sheet 70 is provided with a thin, linear welded portion extending in the axial direction of the developing roller 50. The welded portion in this case extends in the direction perpendicular to the surface of the paper on which FIG. 24 is drawn and can be represented as a dot in FIG. 24.

As the trailing end portion of the sealing sheet 70 is pulled in the direction A, the linear welded portion can be peeled from the face of the doctor blade 52 entirely and simultaneously. In other words, the entire linear welded portion can simultaneously exert drag against the peeling.

Eighth Embodiment

Figure 25:
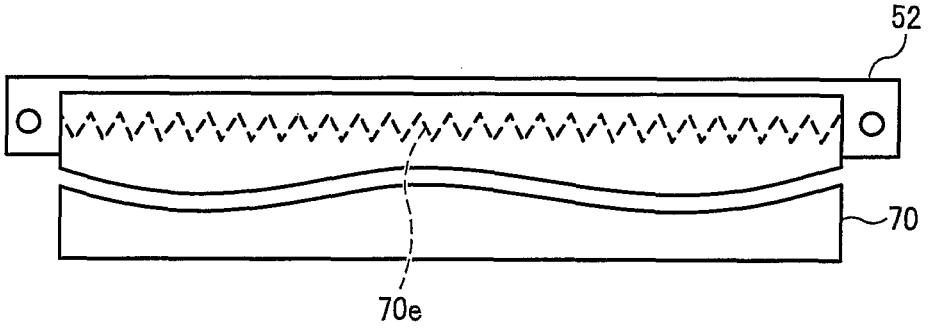
FIG. 25 is a front view of a doctor blade and a sealing sheet according to an eighth embodiment.

FIG. 25 is a front view of the doctor blade 52 and the leading end portion of the sealing sheet 70 according to an eighth embodiment.

In FIG. 25, the doctor blade 52 extends in the direction (i.e., the axial direction of the developing roller 50 shown in FIG. 23) perpendicular to the direction of rotation of the developing roller 50. The sealing sheet 70 shown in FIG. 25 is provided with a welded portion 70*e* welded to the doctor blade 52, and the welded portion 70*e* is shaped like a thin line and serrated (i.e., like saw tooth). It is to be noted that, although the welded portion 70*e* is represented by broken lines in FIG. 25 for ease of understanding, the welded portion 70*e* can be like a continuous thin line. The serrated welded portion 70*e* extends along the long side of the doctor blade 52, that is, the axial direction of the developing roller 50 (shown in FIG. 23).

When the sealing sheet 70 is pulled out, initially portions of the welded portion 70*e* corresponding to cutting edges are peeled from the doctor blade 52. Subsequently, the position peeled moves gradually to the base end of the saw blade shape. Thus, the entire welded portion 70*e* is not peeled off simultaneously. Instead, the welded portion 70*e* is gradually peeled off from the cutting edge to the base of the saw blade shape, and the force for pulling out the sealing sheet 70 can be smaller compared with the configuration in which the welded portion 70*e* is linear. Accordingly, damage to the developing roller 50 in removal of the sealing sheet 70 can be inhibited better.

For example, a heating tool such as an iron dedicated therefor can be produced to form the serrated welded portion 70*e*. A portion of the sealing sheet 70 anterior to the curved portion 70*d* is kept in close contact with the face of the doctor blade 52, and the heated heating tool is pressed against the contact area from the front side of the sealing sheet 70. Thus, the serrated welded portion 70*e* can be created.

It is to be noted that the above-described fixing method using the serrated welded portion 70*e* can adapt to the fourth to seventh embodiments as well as bonding of the welded portion 70*c* according to first to third embodiments.

Ninth Embodiment

Figure 26:
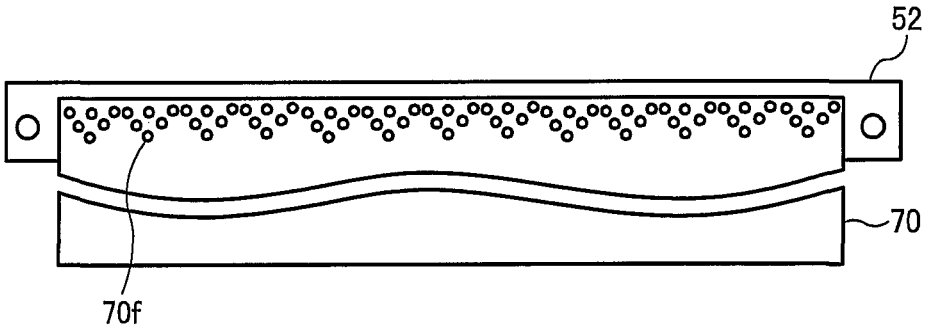
FIG. 26 is a front view of a doctor blade and a sealing sheet according to a ninth embodiment.
Figure 27:
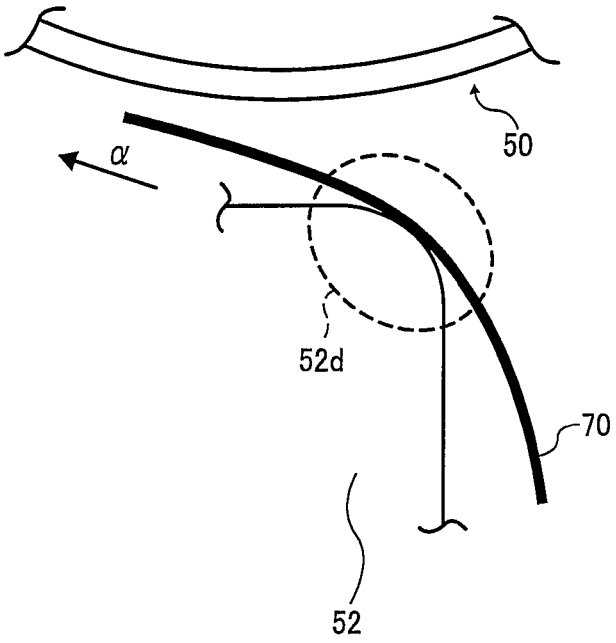
FIG. 27 is an enlarged diagram illustrating a front edge of the doctor blade shown in FIG. 26 together with the sealing sheet.

FIG. 26 is a front view of the doctor blade 52 and the sealing sheet 70 according to a ninth embodiment.

The sealing sheet 70 shown in FIG. 26 is provided with multiple dot-like welded portions 70*f* welded to the doctor blade 52. The dot-like welded portions 70*f* are disposed at positions different in the longitudinal direction of the sealing sheet 70 and the axial direction of the developing roller 50 (shown in FIG. 23).

When the sealing sheet 70 welded to the doctor blade 52 is pulled out, the multiple dot-like welded portions 70*f* are sequentially peeled from the doctor blade 52 from those on the trailing side in the direction in which the sealing sheet 70 is inserted. With this configuration as well, the sealing sheet 70 can be pulled out with a weaker force compared with the linear welded portion, and damage to the developing roller 50 in removal of the sealing sheet 70 can be inhibited better.

For example, a heating tool such as an iron dedicated therefor can be produced to form the multiple dot-like welded portions 70*f*. A portion of the sealing sheet 70 anterior to the curved portion 70*d* is kept in close contact with the face of the doctor blade 52, and the heated heating tool is pressed against the contact area from the front side of the sealing sheet 70. Thus, the multiple dot-like welded portions 70*f* can be created.

It is to be noted that the above-described fixing method using the multiple dot-like welded portions 70*f* can adapt to the fourth to seventh embodiments as well as bonding of the welded portion 70*c* according to first to third embodiments.

[Configurations Common Through the Fourth Through Ninth Embodiments]

Typically grinding or shaving is performed to process the blade-shaped developer regulator to enhance precision in dimensions of the doctor gap. In removal of the sealing sheet 70 from the developing device 5, if the sealing sheet 70 is strongly rubbed on an outer edge 52*d* of the doctor blade 52 on the outer side of the developing device 5, the force for pulling out the sealing sheet 70 increases.

In view of the foregoing, in the fourth through ninth embodiments, the outer edge 52*d* of the doctor blade 52 is chamfered into an R-shape. This configuration can reduce the sliding force between the sealing sheet 70 and the outer edge 52*d* in removal of the sealing sheet 70 and accordingly reduce the force for pulling out the sealing sheet 70, thereby suppressing damage to the developing roller 50.

In any of the fourth embodiment (shown in FIG. 19) through ninth embodiment (shown in FIG. 26), the sealing sheet 70 can be inserted into the developing device 5 from either the upper end 70*b* (i.e., the trailing end) or the lower end 70*a* (i.e., the leading end). In insertion of the sealing sheet 70 from the upper end 70*b*, initially the upper end 70*b* is inserted into the developing device 5 through the doctor gap from outside the developing device 5. Subsequently, the upper end 70*b* is inserted through the clearance between the developing roller 50 and the end of the partition 57 and the clearance (such as the cover opening 580) formed in the upper wall of the casing 58 (development cover 58*c* in particular) to the outside of the casing 58. An area slightly shifted to the middle position from the upper end 70*b* is welded to the upper face of the casing 58, thus forming the welded portion 70*c*. Additionally, while the lower end portion is curved into the curved portion 70*d*, the portion shifted from the curved portion 70*d* to the lower end 70*a* is pressed against, or partly welded to, the doctor blade 52 serving as the supported member supported by the casing 58.

By contrast, in insertion from the lower end 70*a*, initially the lower end 70*a* is inserted into the developing device 5 through the clearance in the upper well from outside the developing device 5. The lower end 70*a* is sequentially inserted through the clearance formed in the upper wall of the casing 58 and the clearance between the developing roller 50 and the end of the partition 57 to the outside of the casing 58. An area slightly shifted to the middle position from the upper end 70*b* is welded to the upper face of the casing 58, thus forming the welded portion 70*c* (shown in FIGS. 19 and 23). Additionally, while the lower end 70*a* is curved into the curved portion 70*d*, the portion shifted from the curved portion 70*d* to the lower end 70*a* is pressed against, or partly welded to, the doctor blade 52 serving as the supported member.

In either insertion method, to enable disposition of the sealing sheet 70 inside the developing device 5 without disassembling the developing device 5, it is preferable that a guide to guide the upper end 70*b* or the lower end 70*a* of the sealing sheet 70 to the respective clearances as required. The clearances include the cover opening 580 formed in the upper wall of the casing 58 as a through hole for the sealing sheet 70, the clearance between the partition 57 and the developing roller 50, and the doctor gap.

As shown in FIG. 19, the sealing member 523 that is elastic is provided to the inner wall defining the cover opening 580. Inside the cover opening 580, the clearance is filled with the elastic sealing member 523 intervening between the sealing sheet 70 and the inner wall. With this configuration, toner can be inhibited from scattering outside the casing 58 through the cover opening 580.

After the sealing sheet 70 is removed from the developing device 5, as shown in FIG. 4, the elastic sealing member 523 expands from the contracted state an amount corresponding to the thickness of the sealing sheet 70 and continues to fill in the clearance. With this configuration, toner can be inhibited from scattering outside the casing 58 through the cover opening 580 after the sealing sheet 70 is removed.

Even if developer contained in the supply compartment 53*a* or the collecting compartment 54*a* adheres to the sealing sheet 70, in removal of the sealing sheet 70, the developer on the sealing sheet 70 is rubbed on the sealing member 523 inside the clearance and is scrapped off from the sealing sheet 70. Since the developer does not remain on the sealing sheet 70, user hands can be free from smear with developer in removal of the sealing sheet 70.

As described above, the sealing sheet 70 is pulled out from the developing device 5 with the trailing end 70*b* gripped by the user. At that time, the sealing sheet 70 exits the casing 58 through the cover opening 580 formed in the upper wall of the casing 58. Pulling out the sealing sheet 70 through the cover opening 580 formed in the upper wall can inhibit interference between the removed sealing sheet 70 and the development range entrance seal 552. Thus, the development range entrance seal 552 can be prevented from bending.

The sealing sheet 70 faces the entire axial length of the developing roller 50. Accordingly, the entire developing roller 50 in the axial direction can be shielded from the supply compartment 53*a* and the collecting compartment 54*a*.

The leading end portion of the sealing sheet 70 can be firmly retained at the predetermined position due to the resilience of the curved portion 70*d* without using glue or adhesive tape, or due to partial welding. In this configuration, even if the leading end portion is rubbed on the sealing member 523 strongly in removal of the sealing sheet 70, leavings of glue or adhesive tape do not drop in the developing device 5. Accordingly, this configuration can inhibit the occurrence of failure caused by intrusion of glue or adhesive tape.

Out of the entire range of the sealing sheet 70 in its longitudinal direction, at least the range that contacts the developing roller 50 in removal of the sealing sheet 70 is preferably formed of a low friction material. With this configuration, damage to the developing roller 50 caused by the sealing sheet 70 rubbing thereon in removal of the sealing sheet 70 can be inhibited better.

It is to be noted that, in a case in which the developing device 5 is filled with developer not at factory before shipment but at a service provider (or a service station), it is desirable that the sealing sheet 70 is installed in the developing device 5 after developer is preset therein at the service provider.

Although the descriptions above concern the developing device 5 having two developer conveyance members (i.e., screws 53 and 54), the various aspects of this specification can adapt to developing devices having three or more developer conveyance members.

Additionally, although the descriptions above concern the developing device 5 in which the collecting screw 54 is above the supply screw 53 and the doctor blade 52 is beneath the developing roller 50, the various aspects of this specification can adapt to configuration in which the collecting screw 54 is beneath the supply screw 53 and the doctor blade 52 is above the developing roller 5.

Further, although the developing roller 50 is provided with five magnetic poles P1 to P5 in the descriptions above, the number of magnetic poles is not limited thereto. The various aspects of this specification can adapt to configuration in which the number of magnetic poles is less than five and greater than five.

Yet further, although the concentration of toner in developer is restored by supplying toner to the developing device 5 in the descriptions above, alternatively developer may be supplied to the developing device 5 to restore the concentration of toner in developer therein. This configuration is feasible when the developing device 5 includes a member to discharge excessive developer from the developing device 5.

Although the descriptions above concerns configurations in which the developing device 5 is incorporated in the process cartridge, alternatively, the developing device 5 can be a discrete unit that is removably installed in the apparatus body independently.

The various configurations according to the present inventions can attain specific effects as follows.

Aspect A: A developing device includes a developer bearer, such as the developing roller 50, to bear developer on its surface due to magnetic force exerted by multiple magnetic poles provided inside the developer bearer, a developer conveyance channel, such as the supply channel 53*a* and the collecting channel 54*a*, through which developer is transported, a developer conveyance member, such as the supply screw 53, to transport developer in the developer conveyance channel in the axial direction of the developer bearer and supply developer to the developer bearer, a development casing, such as the casing 58, that forms the developer conveyance channel, and a developer regulator, such as the doctor blade 52, to adjust the amount of developer carried on the developer bearer. The developer bearer has a cylindrical surface, transports by rotation developer to a development range facing a latent image bearer such as the photoreceptor 1, and supplies developer to a latent image formed on the latent image bearer. The developer regulator is disposed facing a lower portion of the developer bearer. In the developing device, a sheet member such as the sealing sheet 70 extending in the axial direction of the developer bearer is removably installed to seal a communicating area, such as the supply opening 53*b* and the collecting opening 54*b*, through which the developer bearer communicates with the developer conveyance channel.

In a state in which the sheet member is installed, on the side of a first end, such as the lower end 70*a*, of the sheet member, the sheet member passes through the gap (such as the doctor gap) between the developer regulator and the developer bearer with the first end of the sheet member positioned on an outer side than the gap. On the side of a second end of the sheet member, such as the upper end 70*b*, across the communicating are on a cross section perpendicular to the axial direction, the sheet member passes through an opening, such as the cover opening 580, formed in the development casing, such as the development cover 58*c*, positioned above the developer conveyance channel from which developer is supplied to the developer bearer. The second end of the sheet member is positioned outside the development casing.

With this aspect, the developer bearer before use can be inhibited from contacting developer while the developing device can be kept compact as described with reference to the first embodiment.

Aspect B: In the developing device according to aspect A, further a developer collecting member, such as the collecting screw 54, is provided to receive developer that has passed through the development range from the developer bearer and transport the developer axially, the developer conveyance channel is divided by a partition into the supply channel in which the developer supply member is provided and the collecting channel in which the developer collecting member is provided, the communicating opening includes a first communicating opening such as the supply opening 53*b* where the developer bearer faces the supply channel and a second communicating opening such as the collecting opening 54*b* where the developer bearer faces the collecting channel, and the sheet member seals both the first and second communicating openings.

As described above, use of this arrangement in biaxial, unidirectional circulation-type developing devices, such as the developing device 5, can inhibit the inconvenience that image density fluctuations in the axial direction are greater compared with supply-collection common type developing devices. Additionally, the horizontal size of the developing device can be compact compared with triaxial, unidirectional circulation-type developing devices. This configuration can obviate the bonding margin. Accordingly, even if there are multiple openings to be sealed and the opening shape is complicated, such as those in the unidirectional circulation-type developing device, the developer bearer before use can be inhibited from contacting developer while the developing device can be kept compact.

Aspect C: In aspect B, the development casing includes a guide face, such as the sheet guide face 58*e*, on either end in the axial direction to guide the sheet member, and an end face, such as the end face 57*a*, of the partition facing the developer bearer is continuous with the guide faces at the respective ends in the axial direction. In the direction of rotation of the developer bearer, the guide face extends from the end face of the partition to the developer regulator, and a distance between the guide face and the surface of the developer bearer is identical to a distance between the end face of the partition and the surface of the developer bearer. In other words, the guide face has a shape conforming to the shape of the developer bearer such that a distance between the guide face and the surface of the developer bearer is identical to a distance between the end of the partition and the surface of the developer bearer from the end face of the partition to the developer regulator.

With this configuration, as described with reference to FIGS. 10A to 11, the sheet member can move while being guided by the guide face, which can inhibit deformation, such as twist and crease, of the sheet member. Accordingly, shielding between the developer bearer and developer can be secured.

Aspect D: In any of aspects A to C, further a flexible seal member, such as the lateral end seal 570, is provided to either axial end portion of the developer bearer to seal the clearance between the development casing and the surface of the developer bearer, and the first end (e.g., the lower end 70*a*) of the sheet member is interposed between the flexible seal member and the surface of the developer bearer.

With this aspect, as described above with reference to FIG. 8, developer can be inhibited from moving around from outside the axial end of the sheet member to the surface of the developer bearer.

Aspect E: In any of aspects A to D, further a reel device (such as the reel device 525 shown in FIG. 9) is provided to pull the sheet member from the second end (i.e., the upper end 70*b*) and real in the sheet member outside the development casing.

This configuration can obviate manual work performed by the user before the developing device is used, thus streamlining the user's work.

Aspect F: In any of aspects A to E, the sheet member can be removed from the developing device by pulling the second end of the sheet member.

This configuration can inhibit damage to the surface of the latent image bearer such as the photoreceptor 1 and attain good usability in removal of the sheet member.

Aspect G: In any of aspects A to F, further an opening sealing member, such as the sealing member 523, is provided to the opening (i.e., the cover opening 580) formed in the development casing to seal in developer and allow passage of air through the opening.

As described above in the first embodiment, this configuration can inhibit air pressure rise inside the development casing and obviate the necessity of providing a separate member to seal the cover opening 580 or a cleaner of the sheet member, thereby suppressing increases in the cost.

Aspect H: In aspect G, in a state in which the sheet member is installed, the opening sealing member such as the sealing member 523 in FIG. 12, the opening sealing member is positioned on the roller side of the sheet member facing the developing roller 50.

This arrangement can inhibit clogging in the opening sealing member before the developing device is used.

Aspect I: Aspect F or G further includes a sheet cleaner, such as the sheet cleaner 524 shown in FIG. 12, provided to the opening such as the cover opening 580 formed in the casing 58. The sheet cleaner contacts and cleans the first face of the sheet member when the second end (e.g., the upper end 70*b*) of the sheet member is pulled and the sheet member passes through the opening.

With this configuration, as described in the first embodiment, the sheet cleaner 524 can remove the developer adhering to the sheet member. Thus, scattering of developer can be inhibited.

Aspect J: In aspect I, the sheet cleaner includes two planer elastic members, such as the first and second cleaning members 524*a* and 524*b*, disposed across the sheet member in the opening. The planar elastic members are provided to the opening in a bent state and press against each other due to resilience from the bent state.

As described in the second embodiment, with this configuration, the clearance created by deformation of the development casing, such as the development cover 58*c*, can be eliminated, thus keeping the sheet member sandwiched between the two cleaning members. The contact between the sheet member and the two cleaning members can be maintained over the entire range in the axial direction, and the sheet member can be cleaned uniformly.

Aspect K: In aspect J, one (e.g., the first cleaning member 524*a*) of the two planer elastic members on the side of the developer bearer has a higher degree of slidability than the other planer elastic member (e.g., the second cleaning member 524*b*), and the other planer elastic member has a higher degree of cleaning capability than the former.

This configuration can better inhibit scattering of developer while attaining good usability in removal of the sheet member.

Aspect L: In aspect J or K, the sheet cleaner such as those shown in FIGS. 13 to 16 seals the opening (such as the cover opening 580) after the sheet member is removed.

This configuration can inhibit scattering of developer from the opening after the sheet member is removed.

Aspect M: The above-described developing device according to any of aspects A through L is incorporated in an image forming apparatus, such as the image forming apparatus 500, that includes at least the latent image bearer such as the photoreceptor 1, a charging member such as the charging device 40, and a latent image forming device such as the exposure device 46.

By inhibiting developer from adhering to the developer bearer before use, this configuration can inhibit the occurrence of image failure caused by adhesion of developer to the developer bearer before use as described above.

Aspect N: A process cartridge, such as the image forming unit 6, that is removably installed in an apparatus body of an image forming apparatus includes at least the latent image bearer, the developing device according to any of the aspects A through L, and a common unit casing to house those components, thus forming a single modular unit.

As described above, this configuration can prevent or inhibit developer from adhering to the developer bearer such as the developing roller 50 while the image forming unit incorporating the developing device is stored or transported.

Aspect O: The developing device includes the developer container, such as, the supply channel 53*a* and the collecting channel 54*a*, to contain developer, the developer bearer, such as the developing roller 50, such as the doctor blade 52, disposed with its end facing the surface of the developer bearer across the doctor gap to adjust the layer thickness of developer carried on the surface of the developer bearer, and the sheet member, such as the sealing sheet 70, disposed in a communicating area (53*b* or 54*b*) through which the developer bearer faces the developer container in inside the casing of the developing device to seal in developer in the developer container with the leading end (i.e., the first end) of the sheet member passing through the communicating area from the upstream side to the downstream side in the direction of rotation of the developer bearer. The trailing end (i.e., the second end) of the sheet member is pulled in removal of the sheet member.

One end portion (such as the leading end portion) of the sheet member is folded back downstream from the doctor gap in the direction of rotation of the developer bearer, forming a curved portion (such as the curved portion 70*d*).

The end portion of the sheet member may be fixed to the development casing. Alternatively, each of portions adjacent to the curved portion and on the leading side and the trailing side of the sheet member is pressed against the development casing or a supported member (such as the doctor blade 52, the development range entrance seal 552, and the supporter 553) supported by the development casing with the resilience of the curved portion.

In this configuration, the portions on the leading side and the trailing side of the curved portion can be strongly pressed, due to the resilience of the curved portion, against the development casing or the supported member supported by the development casing. Accordingly, the leading end portion of the sheet can exert a relatively large amount of friction force against the development casing or the supported member. With the friction force, the leading end portion is strongly retained at the predetermined position compared with the configuration in which the leading end portion of the sheet member is inserted in a recess. This configuration can inhibit the leading end portion from moving to the trailing end upon vibration or impact during transport, thereby inhibiting leak of developer. Additionally, the force to retain the leading end portion of the sheet member by pressing the leading end portion against the casing 58 or the like can be smaller than that in the configuration in which the leading end portion is welded thereto. Accordingly, the sliding force between the sheet member and the developer bearer in removal of the sheet member can be smaller, thus suppressing damage to the developer bearer.

Aspect P: In aspect O, a portion closer to the first end (i.e., the lower end 70*a*) than the curved portion is pressed against the developer regulator, serving as the supported member, inside the doctor gap. In this configuration, the leading end portion of the sheet member is retained steady at the doctor gap.

Aspect Q: In aspect O, the first portion of the end portion on the leading side of the curved portion is pressed against the development casing or the supported member at a position downstream from the doctor gap in the direction of rotation of the developer bearer. In this configuration, the leading end portion of the sheet member can be steadily retained at the contact position with the development casing or the supported member.

Aspect R: The developing device includes the developer container, the developer bearer, the developer regulator, and the sheet member disposed in a communicating area (53*b* or 54*b*) via which the developer bearer faces the developer container inside the development casing to seal in developer in the developer container with the leading end of the sheet member passing through the communicating area from the upstream side to the downstream side in the direction of rotation of the developer bearer. The trailing end (70*b*) of the sheet member is pulled in removal of the sheet member. The leading end portion of the sheet member is disposed in contact with the development casing or the supported member (52, 552, or 553) downstream from the doctor gap, and the portion of the sheet member in contact with the development casing or the supported member is partly welded thereto.

With this configuration, the sheet member can be pulled out with a weaker force from the development casing or the supported member compared with the configuration in which the entire contact area of the leading end portion is welded. Accordingly, the force to pull out the sheet member can be reduced further, and damage to the developer bearer in removal of the sheet member can be inhibited. Additionally, the leading end portion of the sheet member can be retained more steadily at the contact position with the development casing or the supported member by partly welding the leading end portion compared with the configuration in which the leading end portion is inserted. This configuration can inhibit the leading end portion of the sheet member from moving to the trailing end upon vibration or impact during transport, thereby inhibiting leak of developer.

Aspect S: In aspect R, the leading end portion of the sheet member is curved or bent at a position upstream from the contact area with the development casing or the supported member. With this configuration, the sheet member can be pulled out with a weaker force compared with the case where the curved or bent portion is not provided, and damage to the developer bearer in removal of the sheet member can be inhibited better.

Aspect T: In a developing device including the developer bearer such as the developing roller 50, the development casing 58, the developer conveyance channel (e.g., the supply channel 53*a* and the collecting channel 54*a*), the developer supply member (such as the supply screw 53), and the developer regulator (such as the doctor blade 52), a sheet member (such as the sealing sheet 70) is removably installed in the development casing (58) to seal the communicating area through which the developer conveyance channel faces the developer bearer inside the development casing. The sheet member passes through a gap between the developer regulator and the developer bearer and an opening (such as the cover opening 580) formed in the development casing. A first end (such as the lower end 70*a*) of the sheet member is retained downstream from the gap in a direction of rotation of the developer bearer, and the sheet member is fixed to the development casing at a position across the communicating area from the first end thereof with a second end (such as the upper end 70*b*) of the sheet member opposite the first end (70*a*) positioned outside the development casing.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to transport by rotation developer carried on a surface thereof to a development range to supply developer to a latent image bearer;

a development casing in which a developer conveyance channel is formed, the developer conveyance channel facing the developer bearer through a communicating area inside the development casing;

a developer supply member disposed in the developer conveyance channel to transport developer in an axial direction of the developer bearer and supply developer to the developer bearer;

a developer regulator disposed facing a lower portion of the developer bearer to adjust an amount of developer carried on the developer bearer;

a sheet member removably installed in the development casing to seal the communicating area so as to pass through a gap between the developer regulator and the developer bearer and an opening formed in the development casing, wherein a first end of the sheet member is retained downstream from the gap in a direction of rotation of the developer bearer, and wherein the sheet member is fixed to the development casing at a position across the communicating area from the first end thereof with a second end of the sheet member opposite the first end positioned outside the development casing;

a developer collecting member to axially transport developer received from the developer bearer at a position downstream from the development range in the direction of rotation of the developer bearer; and a partition to divide the developer conveyance channel into a supply channel in which the developer supply member is disposed and a collecting channel in which the developer collecting member is disposed;

wherein the communicating area includes a first communicating opening where the developer bearer faces the supply channel and a second communicating opening where the developer bearer faces the collecting channel;

wherein the sheet member seals both the first communicating opening and the second communicating opening;

wherein a guide face to guide the sheet member is provided at either end of the development casing in the axial direction of the developer bearer;

wherein an end face of the partition facing the developer bearer is continuous with the guide faces at the respective ends in the axial direction;

wherein, in the direction of rotation of the developer bearer, the guide face extends from the end face of the partition to the developer regulator; and wherein a distance between the guide face and the surface of the developer bearer is identical to a distance between the end face of the partition and the surface of the developer bearer.

2. The developing device according to claim 1, further comprising a flexible seal member provided to either axial end portion of the developer bearer to seal a clearance between the development casing and the surface of the developer bearer, wherein the first end of the sheet member is interposed between the flexible seal member and the surface of the developer bearer.

3. The developing device according to claim 1, further comprising a reel device to pull the sheet member from the second end thereof and real in the sheet member outside the development casing.

4. The developing device according to claim 1, further comprising an opening sealing member provided to the opening formed in the development casing to seal in developer and allow passage of air through the opening.

5. The developing device according to claim 4, wherein the opening sealing member is positioned on a side of the sheet member opposed to the developer bearer.

6. The developing device according to claim 4, wherein the opening is formed in an upper portion of the development casing.

7. The developing device according to claim 1, wherein the second end of the sheet member is pulled in removal of the sheet member from the developing device.

8. The developing device according to claim 7, further comprising a sheet cleaner provided to the opening formed in the development casing, wherein the sheet cleaner contacts and cleans a face of the sheet member when the sheet member passes through the opening.

9. The developing device according to claim 8, wherein the sheet cleaner comprises two planar elastic members disposed across the sheet member in the opening.

10. The developing device according to claim 8, wherein the opening is formed in an upper portion of the development casing.

11. The developing device according to claim 9, wherein one of the two planar elastic members on a side of the developer bearer has a higher degree of slidability than the other planar elastic member, and the other planar elastic member has a higher degree of cleaning capability than the former.

12. The developing device according to claim 9, wherein the sheet cleaner seals the opening formed in the development casing after the sheet member is pulled out therefrom.

13. The developing device according to claim 1, wherein an end portion of the sheet member including the first end is folded back downstream from the gap in the direction of rotation of the developer bearer.

14. The developing device according to claim 13, wherein the sheet member is pressed against the developer regulator inside the gap.

15. An image forming apparatus comprising:

a latent image bearer on which a latent image is formed; and a developing device to develop with developer the latent image, a developer bearer to transport by rotation developer carried on a surface thereof to a development range to supply developer to the latent image bearer;

a development casing in which a developer conveyance channel is formed, the developer conveyance channel facing the developer bearer through a communicating area inside the development casing;

a developer supply member disposed in the developer conveyance channel to transport developer in an axial direction of the developer bearer and supply developer to the developer bearer;

a developer regulator disposed facing a lower portion of the developer bearer to adjust an amount of developer carried on the developer bearer;

a sheet member removably installed to seal the communicating area between the developer bearer and the developer conveyance channel so as to pass through a gap between the developer regulator and the developer bearer and an opening formed in the development casing, wherein a first end of the sheet member is retained downstream from the gap in a direction of rotation of the developer bearer, wherein the sheet member is fixed to the development casing at a position across the communicating area from the first end thereof with a second end of the sheet member opposite the first end positioned outside the development casing;

a developer collecting member to axially transport developer received from the developer bearer at a position downstream from the development range in the direction of rotation of the developer bearer; and a partition to divide the developer conveyance channel into a supply channel in which the developer supply member is disposed and a collecting channel in which the developer collecting member is disposed;

wherein the communicating area includes a first communicating opening where the developer bearer faces the supply channel and a second communicating opening where the developer bearer faces the collecting channel;

wherein the sheet member seals both the first communicating opening and the second communicating opening;

wherein a guide face to guide the sheet member is provided at either end of the development casing in the axial direction of the developer bearer;

wherein an end face of the partition facing the developer bearer is continuous with the guide faces at the respective ends in the axial direction;

wherein, in the direction of rotation of the developer bearer, the guide face extends from the end face of the partition to the developer regulator; and wherein a distance between the guide face and the surface of the developer bearer is identical to a distance between the end face of the partition and the surface of the developer bearer.

16. A developing device comprising:

a developer bearer to transport by rotation developer carried on a surface thereof to a development range to supply developer to a latent image bearer;

a development casing in which a developer conveyance channel is formed, the developer conveyance channel facing the developer bearer through a communicating area inside the development casing;

a developer supply member disposed in the developer conveyance channel to transport developer in an axial direction of the developer bearer and supply developer to the developer bearer;

a developer regulator disposed facing a lower portion of the developer bearer in a gravity direction, and to adjust an amount of developer carried on the developer bearer; and a sheet member removably installed in the development casing to seal the communicating area so as to pass through a gap between the developer regulator and the developer bearer and an opening formed in the development casing;

wherein a first end of the sheet member is retained downstream from the gap in a direction of rotation of the developer bearer at a first location, and a second end of the sheet member is attached to an outside of the development casing at a second location;

wherein a virtual straight line connecting the first location and the second location of the sheet member is diagonal with respect to the gravity direction, wherein the virtual straight line intersects the developer bearer disposed inside the development casing, and wherein the first location and the second location are on opposite sides of the developer bearer in a horizontal direction that is perpendicular to the gravity direction such that a range of the sheet member contacting around the developer bearer is less than half of one cycle of the surface in a rotational direction of the developer bearer;

wherein the opening is formed in an upper portion of the development casing; and wherein the second end of the sheet member is attached on an outer surface of the upper portion, and pulled in removal of the sheet member from the developing device.

17. The developing device according to claim 16, further comprising, further comprising:

a developer collecting member to axially transport developer received from the developer bearer at a position downstream from the development range in the direction of rotation of the developer bearer; and a partition to divide the developer conveyance channel into a supply channel in which the developer supply member is disposed and a collecting channel in which the developer collecting member is disposed, wherein the communicating area includes a first communicating opening where the developer bearer faces the supply channel and a second communicating opening where the developer bearer faces the collecting channel, and the sheet member seals both the first communicating opening and the second communicating opening.

18. The developing device according to claim 16, further comprising a flexible seal member provided to either axial end portion of the developer bearer to seal a clearance between the development casing and the surface of the developer bearer, wherein the first end of the sheet member is interposed between the flexible seal member and the surface of the developer bearer.

19. The developing device according to claim 16, further comprising a reel device to pull the sheet member from the second end thereof and real in the sheet member outside the development casing.

* * * * *